United States Patent [19]

Liu

[11] Patent Number: 4,968,357

[45] Date of Patent: Nov. 6, 1990

[54] HOT-ROLLED ALLOY STEEL PLATE AND THE METHOD OF MAKING

[75] Inventor: Tzeng-Feng Liu, Hsinchu, Taiwan

[73] Assignee: National Science Council, Taipei, Taiwan

[21] Appl. No.: 298,043

[22] Filed: Jan. 18, 1989

[51] Int. Cl.[5] ..... C21D 8/02; C22C 38/04

[52] U.S. Cl. ..... 148/12.1; 148/12 R; 148/329

[58] Field of Search ..... 420/72, 75, 78; 148/329, 12 R, 12.1

[56] References Cited

U.S. PATENT DOCUMENTS 3,193,384 7/1965 Richardson ..... 148/329

*Primary Examiner*—Deborah Yee

*Attorney, Agent, or Firm*—Cushman, Darby & Cushman

[57] ABSTRACT

A hot-rolled alloy steel plate with fully austenitic structure consisting essentially of 4.5 to 10.5 wt % aluminum, 22 to 36 wt % manganese, 0.4 to 1.25 wt % carbon and at least one of the following constituents, 0.06 to 0.50 wt % titanium, 0.02 to 0.20 wt % niobium and 0.10 to 0.40 wt % vanadium, the balance being iron. Among them, there are some special relationships between aluminum and carbon contents: when the aluminum content is below about 9.5 wt %, the carbon content can reach 1.25 wt %, but when the aluminum content is between 9.5–10.5 wt %, the carbon content should be less than 1.10 wt %. The alloys of this invention may further contain the following constituents to improve the strength without remarkable decrease in ductility: up to 0.5 wt % nickel, up to 0.5 wt % chromium, up to 1.2 wt % silicon, up to 0.5 wt % molybdenum and up to 0.5 wt % tungsten. The present invention also relates to a process for manufacturing the hot-rolled alloy steel plate.

8 Claims, 29 Drawing Sheets

HOT-ROLLED ALLOY STEEL PLATE AND THE METHOD OF MAKING

DETAILED DESCRIPTION OF THE INVENTION

The present invention relates to a hot-rolled alloy steel plate. It particularly concerns about the hot-rolled steel plate with austenitic structure. By suitable addition of alloying elements and by controlling hot-rolled condition, the steel plate of the present invention acquires an outstanding combination of strength and ductility in as hot-rolled condition.

BACKGROUND OF THE INVENTION

Recently, to promote Fe-Al-Mn-C alloy to be a high strength-high ductility alloy steel has been one of the major objects for the researchers of the Fe-Al-Mn-C alloy. It has been found that high strength-high ductility can be achieved by controlling the contents of aluminum, carbon and manganese so as to obtain a fully austenitic structure and by performing the heat treatment including solution heat treatment, quenching and aging so as to obtain fine (Fe, Mn)$_3$AlC$_x$ carbides precipitated coherently within austenite matrix. The heat treatment processes and their effects on microstructures and mechanical properties have been extensively studied. The following papers have described these characteristics in detail.

"The Structure and Properties of Austenitic Alloys Containing Aluminum and Silicon" by D. J. Schmatz, Trans. ASM., vol. 52, p. 898, 1960; "Fe-Mn-Al Precipitation-Hardening Austenitic Alloys" by G. L. Kayak, Metal Sci. and Heat Treatment, vol. 2, p. 95, 1969; "Phase Composition, Structure and Properties of Low-Density Steel 9G28Yu9MVB" by M. F. Alekseenko et al., Metal Sci. and Heat Treatment, vol. 14, p. 187, 1972; "Phase Transformation Kinetics in Steel 9G28Yu9MVB" by G. B. Krivonogov et al., Phys. Met. & Metallog., vol. 4, p. 86, 1975; "Structural & Phase Change in Steel 9G28Yu9MVB During Aging" by L. I. Lysak et al., Metallogizika, vol. 59, p. 29, 1975; "State of the Surface Layer and Corrosion Resistance of Steel 9G28Yu9MVB" by V. P. Batrakov et al., Prot. Met., vol. 10, p. 487, 1974; "Aluminum-Manganese-Iron Alloys" by R. E. Cairns and J. L. Ham, U.S. Pat. No. 3,111,405, 1963; "Manganese-Aluminum Steel" by G. S. Brady, Materials Handbook, Rev. 10, p. 497; "An Assessment of Fe-Mn-Al Alloys as Substitutes for Stainless Steel" by H. W. Leavenworth, Jr. & J. C. Benz, Journal of Metals, p. 36, March, 1985; "New Cryogenic Materials: Fe-Mn-Al Alloys" by J. Charles et al., Metal Progress, p. 71, May, 1981; "Processing and properties of Fe-Mn-Al Alloys" by C. J. Altstetter et al., Materials Sci. and Engineering, vol. 82, p. 13, 1986; "The Evidence of Modulated Structure in Fe-Mn-Al-C Austenitic alloys" by Kwan H. Ham et al., Scripta Metal., vol. 20, p. 33, 1986; "Precipitation of the Carbide (Fe,Mn)$_3$AlC in an Fe-Al Alloy" by P. J. James, J. Iron & Steel Inst., p. 54, January, 1969.

Reviewing the above noted references, it can be found that the chemical composition range examined is Fe-(7-16) wt % Al-(20-40) wt % Mn-(0.3-2.0) wt % C-(0-2.0) wt % Si-(0-10) wt % Ni. To obtain the required strength, the alloy containing the chemical composition within this range should be solution heat treated at temperatures ranging from 950° C. to 1200° C., then rapidly quenched into water, oil or other quench media, and finally aged at temperatures ranging from 450° C. to 750° C. for various time. Based on the above noted references, the effects of aging temperature on microstructures and mechanical properties can be approximately divided into the following two stages: (1) First stage (400° C. to 550° C.). When the alloy was aged within this temperature range, fine (Fe,Mn)$_3$AlC$_x$ carbides started to precipitate coherently within austenite matrix. The size of (Fe,Mn)$_3$AlCx carbides was about 300 to 600 Å depending on chemical composition, aging temperature and aging time. Due to the formation of fine (Fe,Mn)$_3$AlCx carbides within austenite matrix, the strength was remarkably increased without significant loss in ductility. The peak value of strength would be reached when the alloy was aged at about 550° C. for time periods ranging from 4 to 16 hours. The ultimate strength, yield strength and elongation thus obtained were in the ranges of 138≧176 ksi, 120–165 ksi and 46–22% respectively. (2) Second stage (550° C. to 750° C.) Two kinds of precipitates, namely (Fe,Mn)$_3$AlCx carbide and A13 $\beta$-Mn could be observed when the alloy was aged within this temperature range. The (Fe,Mn)$_3$AlC$_x$ carbides were found to precipitate not only coherently within austenite matrix, but also on grain boundaries in the form of coarser particle. The higher the aging temperature, the more the quantity of the grain boundary carbides. Besides the precipitation of (Fe,Mn)$_3$AlC$_x$ carbides, A13 $\beta$-Mn precipitates were always observed to form on the grain boundaries through the transformation of austenite structure to ferrite structure plus A13 $\beta$-Mn. The formation of (Fe,Mn)$_3$AlC$_x$ carbides and A13 $\beta$-Mn precipitates on grain boundaries resulted in the embrittlement of the alloy.

It can be concluded from the above discussion that the Fe-Al-Mn-C alloys can possess high strength-high ductility after being aged at about 550° C. However, it is necessary to perform the complicated heat treatment including solution heat treatment, quenching and aging.

The mechanical properties of Fe-Al-Mn-C based alloys in as hot-rolled condition have been reported in the following papers: "An Assessment of Fe-Mn-Al Alloys as Substitutes for Stainless Steel" by J. C. Benz et al., Journal of Metals, p. 36, March, 1985; and "Low Temperature Mechanical Behavior of Microalloyed and Controlled-Rolled Fe-Mn-Al-C-X Alloys" by Young G. Kim et al, Metal. Trans. A, p. 1689, September 1985. The chemical compositions and mechanical properties reported in these two papers are listed in Table I and Table II of this invention for comparison with those of the steels obtained from the present invention. In Table II, it is clear that the strength of their alloys in as hot-rolled condition is not satisfactorily high enough.

So the major characteristic of the present invention is, by suitable addition of alloying elements and by controlling hot-rolled condition, to produce a steel plate having an outstanding combination of strength and ductility in as hot-rolled condition. In accordance with the present invention, the mechanical properties of the steel plate are as good or better than those of the other recently developed Fe-Al-Mn-C alloys which have been performed complicated heat treatment.

DESCRIPTION OF THE INVENTION

The microstructures and mechanical properties of Fe-Al-Mn-C alloys with or without silicon and nickel have been extensively investigated in the present work, and the results are summarized as follows: (1) The amount of $(Fe,Mn)_3AlC_x$ carbides precipitated in the hot-rolled alloy was primarily dependent on the aluminum and carbon contents (2) When the alloy was continuously hot-rolled and air-cooled from the finish rolling temperature to room temperature, the $(Fe,Mn)_3AlC_x$ carbides precipitated within austenite matrix tended to be coarsened, and the shape of carbides appeared to be a plate-like morphology with certain preferred orientations. Generally speaking, these carbides were about six times larger than those in the alloy having the same chemical composition after being solution heat treated, quenched and aged at around 550° C. (3) when the alloy was continuously hot-rolled and then rapidly quenched into water from the finish rolling temperature, no $(Fe,Mn)_3AlC_x$ carbides were found within austenite matrix or on grain boundaries. The result indicated that $(Fe,Mn)_3AlC_x$ carbides should be precipitated during the air-cooling process from the finish rolling temperature to room temperature. (4) The additions of silicon and nickel did not enhance the precipitation of $(Fe,Mn)_3AlC_x$ carbides. (5) The tensile-test results showed that the Fe-Al-Mn-C alloys with or without silicon and nickel in as hot-rolled condition could not achieve a satisfactory strength. Some chemical compositions of these alloys and their mechanical properties in as hot-rolled condition are listed in Table I, Table II and Examples respectively for comparison with those of the steel plate obtained from the present invention.

Consequently, to obtain an outstanding combination of strength and ductility in as hot-rolled condition, the steel plate of the present invention should essentially consist of the following elements (indicated in percent by weight): 4.5 to 10.5 percent aluminum, 22.0 to 36.0 percent manganese, 0.4 to 1.25 percent carbon, less than 0.5 percent nickel, less than 1.2 percent silicon, less than 0.5 percent molybdenum, less than 0.5 percent tungsten, less than 0.5 percent chromium and at least one of the following elements, 0.06 to 0.50 percent titanium, 0.02 to 0.20 percent niobium and 0.10 to 0.40 percent vanadium; the balance essentially iron. Among them, there are special relationships between aluminum and carbon contents: When the aluminum content is below about 9.5 wt %, the carbon content can reach 1.25 wt %, but when the aluminum content is between 9.5 and 10.5 wt %, the carbon content should be less than 1.10 wt %.

In accordance with the present invention, the chemical composition of the hot-rolled steel plate should be limited as above, and the reasons are as follows:

Aluminum

Variations in aluminum content have strong effects on both the quantity and the distribution of $(Fe,Mn,M)_3AlC_x$ carbides in the hot-rolled steel plate of the present invention, where the letter "M" stands for titanium, niobium and/or vanadium. When the aluminum content is less than 4.5 wt %, there is no appreciable amount of $(Fe,Mn,M)_3AlC_x$ carbides precipitated within austenite matrix and the steel plate can not achieve a satisfactory strength in as hot-rolled condition. When the aluminum content is between 4.5 and 10.5 wt %, a significant amount of $(Fe,Mn,M)_3AlC_x$ carbides will be precipitated coherently within austenite matrix and thus the steel plate can possess an excellent strength accompanied with a high ductility. When the aluminum content is above 10.5 wt %, $(Fe,Mn,M)_3AlC_x$ carbides start to form on the austenite grain boundaries in addition to within austenite matrix. The quantity and the size of grain boundary carbides increase with increasing the aluminum content. The formation of grain boundary carbides not only is helpless to increase the strength but also deteriorates the ductility of the hot-rolled steel plate rapidly. In accordance with the experimental results of the present invention, the aluminum content should be limited within the range of 4.5 to 10.5 wt %.

Carbon

The effects of aluminum and carbon contents on the microstructures and mechanical properties have been extensively studied in the present invention. Some results are shown in FIG. 1 and Examples 2–4. FIG. 1 shows the relationships between aluminum content, carbon content and the mechanical properties of the Fe-29.8 wt % Mn-0.12 wt % Ti-0.08 wt % Nb-Al-C alloy in which the aluminum and carbon contents vary from 3.5 to 11.5 wt % and 0.30 to 1.50 wt % respectively. The experimental results indicate that (1) Having a significant amount of $(Fe,Mn,M)_3AlC_x$ carbides within austenite matrix is a prerequisite for the steel to possess a satisfactory strength. In order to reach the object, the steel should contain at least 4.5 wt % aluminum and 0.4 wt % carbon. (2) In the steels containing 4.5-9.5 wt % aluminum and below about 1.25 wt % carbon or containing 9.5–10.5 wt % aluminum and below about 1.10 wt % carbon, fine $(Fe,Mn,M)_3AlC_x$ carbides only precipitate within austenite matrix and no carbides form on the grain boundaries. The tensile-test results show that the strength increases in accompany with increasing the aluminum and carbon contents, without any marked loss in ductility. (3) In the steels containing 4.5–9.5 wt % aluminum and above about 1.25 wt % carbon or containing 9.5–10.5 wt % aluminum and above about 1.10 wt % carbon, the ductility suffers a rapid decrease, which is caused by the presence of coarser carbides on grain boundaries. (4) The steel with above 10.5 wt % aluminum content has a very poor ductility. During hot rolling process, a considerable amount of cracks can be found all over the steel plate.

Manganese

A large amount of manganese is added to stabilize the austenite structure, which is beneficial to enhance the workability and ductility of the steel. To obtain excellent workability and ductility, the hot-rolled steel of the present invention should contain at least about 22.0 wt % manganese. However, if the manganese content exceeds about 36.0 wt %, some cracks are formed in the steel plate during hot rolling process. Consequently, the manganese content should be limited within the range from 22.0 to 36.0 wt % in the present invention.

Titanium, Niobium and Vanadium

The addition of small amount of titanium, niobium and/or vanadium in conjunction with controlled rolling processes leads to the formation of extremely fine $(M)_3AlC_x$ carbides (where the letter "M" stands for titanium, niobium and/or vanadium) precipitated coherently within austenite matrix at the finish rolling temperature in the steel plate of the present invention. During air-cooling from the finish rolling temperature to room temperature, the pre-existing extremely fine carbides within austenite matrix act as nuclei for precipitates to grow, which results in a large amount of fine $(Fe,Mn,M)_3AlC_x$ carbides within austenite matrix.

In order to further demonstrate the effects of titanium, niobium and/or vanadium addition on both the precipitation of carbides and mechanical properties, a series of experiments was carried out.

After being continuously hot-rolled and then rapidly quenched into water from the finish rolling temperature; the microstructure of the steel plate containing no alloying element of titanium, niobium and/or vanadium showed no carbides precipitated within austenite matrix; If the steel plate was continuously hot-rolled and air-cooled from the finish rolling temperature to room temperature, the carbides precipitated within austenite matrix were very coarse. The size of these carbides was about 3600 Å to 32000 Å in length and 520 Å to 2200 Å in width, as illustrated in Example 1. The tensile-test result showed that the steel plate could not achieve a satisfactory strength.

In contrast to above results, when the steel plate containing at least one of alloying elements titanium, niobium and/or vanadium was continuously hot-rolled and then rapidly quenched into water from the finish rolling temperature, the extremely fine $(M)_3AlC_x$ carbides were found to be precipitated coherently within austenite matrix; If the steel was continuously hot-rolled and air-cooled from the finish rolling temperature to room temperature, the carbides precipitated within austenite matrix were very fine. The size of these carbides was about 100 Å to 300 Å. This is the reason why the steel plate of the present invention can possess an excellent tensile strength accompanied with a high ductility in as hot-rolled condition.

The effects of the titanium, niobium and/or vanadium addition on the mechanical properties of hot-rolled steel plate are shown in FIG. 2. In FIG. 2, it can be seen that the strength of the hot-rolled steel plate increases conspicuously when the content of titanium, niobium or vanadium is added up to about 0.06, 0.02 or 0.10 wt % respectively; and the strength reaches a maximum value when the content is increased to about 0.50, 0.20 or 0.40 wt % respectively.

From the above experimental results, it is clear that the hot-rolled steel plate of the present invention should contain at least one of titanium, niobium and vanadium. The titanium content is limited from 0.06 to 0.50 wt %; niobium from 0.02 to 0.20 wt % and vanadium from 0.10 to 0.40 wt %.

Nickel

Nickel is added in amount up to about 1.8 wt % in several commercialized alloy steels (e.g. AISI 4340) and in amount up to above 8.0 wt % in commercialized austenitic stainless steels (e.g. ASTM 304). In the alloy steels, nickel is added to increase the notch toughness by lowering the ductile-brittle transition temperature. In the austenitic stainless steels, sufficient nickel is added to improve the ductility and formability by making it possible for the austenitic structure (FCC) to be retained at room temperature.

In the Fe-Al-Mn-C alloy system, the effect of nickel addition on mechanical properties has been reported in U.S. Patent 3111405. Three alloy steels with the chemical compositions of Fe-10.0 wt % Al-0.27 wt % C-33.8 wt % Mn-2.3 wt % Ni, Fe-12.5 wt % Al-0.30 wt % C-33.0 wt % Mn-4.3 wt % Ni and Fe-9.3 wt % Al-0.34 wt % C-35.4 wt % Mn-6.4 wt % Ni respectively were examined in this patent. It has been predicated that after being heated at 2000° F. and then quenched into oil or furnace-cooled to room temperature respectively, all the three alloy steels possess very excellent elongation ranging from 25 to 45%.

In the present invention, detailed experiments have been conducted on the effects of nickel addition on microstructures and mechanical properties. The results are shown in FIG. 3 and Example 6. The chemical composition of the steel examined is Fe-8.0 wt % Al-28.5 wt % Mn-0.90 wt % C-0.30 wt % Ti with various amount of nickel ranging from 0 to 5.0 wt %. The result is very surprising. When the nickel content is less than about 0.5 wt %, the ductility of the hot-rolled steel plate is slightly increased. However, some rod-like precipitates with widmanstätten structure start to form within austenite matrix when the nickel content is added over about 1.0 wt %, which results in a remarkable decrease in ductility. Based on the analyses of transmission electron microscopy (TEM), it can be confirmed that these rod-like precipitates have an ordered body-centered cubic structure which belongs to B2-type (NiAl), as shown in Example 6. The amount of B2-type ordered phase increases with increasing nickel content. When the nickel content reaches about 2.5 wt %, a considerable amount of cracks can be found all over the steel plate after hot rolling. Thus, in accordance with the present invention, the nickel content should be strictly limited below about 0.5 wt %.

Silicon

The effects of silicon addition on both microstructures and mechanical properties have also been studied in the present invention. Some results are shown in FIG. 4 and Example 7. The chemical composition of the steel examined is Fe-6.0 wt % Al-25.0 wt % Mn-0.75 wt % C-0.16 wt % Nb with various amount of silicon ranging from 0 to 2.0 wt %. The results show that when the silicon content is below about 1.2 wt %, the strength of the hot-rolled steel plate is slightly increased with increasing the silicon content, without significant loss in ductility. However, when the silicon content reaches about 1.2 wt % or above, the ductility suffers a remarkable decrease through the formation of $DO_3$-type ordered phase, as shown in Example 7 and FIG. 4. Thus in accordance with the present invention, the silicon content should be limited below about 1.2 wt %.

Chromium, Molybdenum and Tungsten

Chromium, molybdenum and tungsten are very strong carbide formers. They are generally added to enhance the mechanical properties of the commercialized alloy steels. In the present invention, detailed experiments have been conducted on the effects of chromium, molybdenum and tungsten additions on both the precipitation of carbides and mechanical properties. Some results are shown in Examples 8–10 respectively. The results indicate that when the chromium, molybdenum or tungsten content is less than about 0.5 wt %, the strength of the hot-rolled steel plate is slightly increased with increasing the chromium, molybdenum or tungsten content without remarkable drop in ductility. However, some coarse precipitates start to form on grain boundaries, twin boundaries and within austenite matrix when the chromium, molybdenum or tungsten content is added up to about 1.0 wt % or above, which causes a remarkable decrease in ductility. Based on the analyses of transmission electron microscopy, these precipitates are determined to be $(Fe,Cr)_7C_3$ carbides in Cr-bearing alloys, $(Fe,Mo)_6C$ carbides in Mo-bearing alloys and $(Fe,W)_6C$ carbides in W-bearing alloys respectively, as shown in Examples 8–10. The amount of these coarse carbides obviously increases with increasing the chromium, molybdenum or tungsten content.

The formation of these coarse carbides causes the denudation of carbon, which suppresses the precipitation of extremely fine $(Fe,Mn,M)_3AlC_x$ carbides. Thus in accordance with the present invention, the chromium, molybdenum or tungsten content should be strictly limited below about 0.5 wt %.

Another important feature of the present invention is to control the continuous hot-rolling condition. The reasons are as follows:

The effects of the finish rolling temperature on both microstructures and mechanical properties of the hot-rolled steel plate have been studied in the present invention. After being heated at temperatures ranging from 1050° C. to 1250° C. for two hours, the steel ingot with size of 80 mm in width, 40 mm in thickness and 300 mm in length was continuously hot-rolled to a final thickness of 5.0 mm and then air-cooled from the finish rolling temperature to room temperature. The finish rolling temperature was controlled to be between 800° C. and 1000° C. The results showed that when the finish rolling temperature was between 920° C. and 1000° C., the $(Fe,Mn,M)_3AlC_x$ carbides precipitated coherently within austenite matrix. But when the finish rolling temperature was approximately between 800° C. and 920° C., a high density of dislocation cells remained within austenite matrix and a large amount of tiny $(Fe,Mn,M)_3AlC_x$ carbides was formed on the dislocation cells. Due to the formation of dislocation cell substructure and the precipitation of tiny $(Fe,Mn,M)_3AlC_x$ carbides, the strength of the hot-rolled steel plate has a remarkable increase without significant decrease in ductility, as shown in Example 5 and Table II.

Furthermore, in order to demonstrate the excellence of the present invention, part of the chemical compositions and tensile-test results of the hot-rolled alloy steel plates obtained from the present invention are listed in Table I and Table II respectively. The characteristics of the well-known commercialized hot-rolled steel plates and other known Fe-Al-Mn-C alloys are also included for comparison. These results illustrated is only to clarify the features of the hot-rolled steel plate of the present invention, and they should not be deemed as the scope of the present invention.

TABLE I

The Chemical Compostitions of Sample Steels of the Present Invention and Steels Used for Comparison (wt %)

| No. | Al | Mn | C | Ti | Nb | V | Other Alloying Elements | Remarks |
|---|---|---|---|---|---|---|---|---|
| 1 | 9.47 | 29.6 | 0.86 | | 0.08 | | | The |
| 2 | 4.76 | 24.8 | 0.55 | 0.15 | | | | Sample |
| 3 | 7.02 | 26.3 | 0.61 | 0.40 | | | Si = 0.50 | Steels |
| 4 | 5.01 | 32.0 | 1.10 | 0.21 | | | | of |
| 5 | 7.50 | 29.8 | 1.20 | 0.12 | 0.06 | | | the |
| 6 | 9.03 | 28.3 | 0.85 | 0.36 | | | Cr = 0.42 | Present |
| 7 | 6.97 | 25.9 | 0.64 | | | 0.20 | Cr = 0.35 Mo = 0.25 | Invention |
| 8 | 7.56 | 25.2 | 0.78 | 0.35 | 0.18 | | W = 0.34 | |
| 9 | 4.53 | 26.4 | 0.73 | | 0.12 | | | |
| 10 | 9.41 | 29.7 | 1.02 | 0.38 | 0.12 | 0.11 | Mo = 0.35 | |
| 11 | 5.03 | 26.4 | 0.58 | | | 0.36 | | |
| 12 | 8.02 | 28.5 | 0.90 | 0.30 | | | Ni = 0.50 | |
| 13 | 7.48 | 30.1 | 0.76 | 0.09 | 0.10 | | | |
| 14 | 7.38 | 27.1 | 0.86 | 0.16 | | | Cr = 0.21 Si = 0.53 | |
| 15 | 6.72 | 27.7 | 0.59 | | 0.11 | | Ni = 0.43 Cr = 0.18 | |
| 16 | 6.84 | 30.4 | 0.91 | | 0.03 | | | |
| 17 | 9.46 | 27.8 | 0.96 | 0.31 | | | | |
| 18 | 6.20 | 31.3 | 0.77 | 0.28 | | | Mo = 0.36 | |
| 19 | 10.46 | 29.3 | 0.95 | 0.20 | | | Ni = 0.20 | |
| 20 | 9.34 | 29.5 | 1.05 | 0.35 | 0.10 | | W = 0.30 | |
| 21 | 4.98 | 29.6 | 0.90 | 0.13 | 0.09 | | | |
| 22 | 5.03 | 29.3 | 0.55 | | 0.09 | | | |
| 23 | 6.42 | 22.3 | 0.66 | | 0.09 | 0.21 | Mo = 0.18 | |
| 24 | 6.58 | 29.1 | 0.78 | 0.11 | | 0.12 | | |
| 25 | 4.97 | 26.1 | 0.58 | 0.16 | | | | |
| 26 | 5.36 | 27.5 | 0.65 | 0.46 | | | | |
| 27 | 8.56 | 27.4 | 0.90 | | 0.13 | 0.32 | Ni = 0.31 W = 0.45 | |
| 28 | 6.30 | 26.4 | 0.68 | | 0.15 | | | |
| 29 | 5.77 | 25.2 | 0.66 | 0.09 | | 0.18 | Si = 1.21 | |
| 30 | 6.86 | 28.7 | 0.58 | | 0.06 | | W = 0.20 | |
| 31 | 7.51 | 29.8 | 0.95 | | 0.07 | | | |
| 32 | 6.98 | 30.1 | 0.64 | | | 0.12 | Cr = 0.50 Si = 1.00 | |
| 33 | 5.52 | 25.8 | 0.46 | 0.21 | 0.08 | | Si = 0.48 | |
| 34 | 7.47 | 29.5 | 0.88 | 0.14 | 0.08 | | | |
| 35 | 9.12 | 34.6 | 0.87 | | | 0.41 | | |
| 36 | 9.47 | 30.2 | 1.10 | 0.11 | 0.09 | | Si = 1.00 Mo = 0.20 | |
| 37 | 7.12 | 26.5 | 0.63 | 0.32 | | | Cr = 0.21 | |
| 38 | 6.47 | 27.2 | 0.74 | | 0.18 | 0.24 | | |
| 39 | 7.04 | 29.3 | 0.93 | 0.27 | | | | |
| 40 | 7.82 | 28.6 | 1.06 | | 0.05 | 0.24 | Mo = 0.19 | |
| 41 | 9.42 | 27.6 | 0.93 | 0.28 | | | | |
| 42 | 6.22 | 29.6 | 0.81 | 0.42 | | | W = 0.28 | |
| 43 | 6.12 | 26.0 | 0.57 | 0.17 | | | Cr = 0.24 | |
| 44 | 9.03 | 28.3 | 0.85 | | | | | The |
| 45 | 7.49 | 29.5 | 1.31 | 0.12 | 0.08 | | | Sample |
| 46 | 7.47 | 29.6 | 1.42 | 0.13 | 0.06 | | | Steels |
| 47 | 11.30 | 31.6 | 1.09 | 0.20 | | | | Used |
| 48 | 3.61 | 25.3 | 0.56 | 0.15 | | | | for |
| 49 | 9.00 | 28.5 | 0.90 | 0.30 | | | Ni = 4.00 | Comparison |
| 50 | 6.00 | 25.0 | 0.75 | | 0.20 | | Si = 1.40 | |
| 51 | 6.24 | 31.1 | 0.79 | 0.30 | | | Mo = 4.48 | |
| 52 | 6.20 | 29.8 | 0.80 | 0.41 | | | W = 2.86 | |

TABLE I-continued

| The Chemical Compostitions of Sample Steels of the Present Invention and Steels Used for Comparison (wt %) | | | | | | | | |
|---|---|---|---|---|---|---|---|---|
| No. | Al | Mn | C | Ti | Nb | V | Other Alloying Elements | Remarks |
| 53 | 7.11 | 26.8 | 0.65 | 0.31 | | | Cr = 3.50 | |
| 54 | 8.00 | 30.0 | 1.00 | | | | Si = 1.50 | |
| 55 | 10.00 | 34.5 | 0.76 | | | | | |
| 56 | 5.00 | 30.0 | 0.30 | | | | | |
| 57 | 5.00 | 30.0 | 0.30 | | 0.10 | | | |
| 58 | 5.00 | 30.0 | 0.30 | | | 0.10 | | |
| 59 | | 0.90 | 0.12 | | | 0.10 | Si = 0.35 Ni = 5.25 Cr = 0.70 Mo = 0.65 | |
| 60 | | 0.40 | 0.20 | | | | Si = 0.35 Ni = 3.50 Cr = 1.80 Mo = 0.60 | |

Brief Description of Table I (1) No. 1 to No. 43 show the chemical compositions of the sample steels of the present invention.

(2) No. 44 to No. 53 show the chemical compositions of the sample steels used for comparison.

(3) No. 54 to No. 55 show the chemical compositions of the steels used for comparison (according to "An Assessment of Fe—Mn—Al Alloys as Substitutes for Stainless Steel" by H. W. Leavenworth, Jr. and J. C. Benz, Journal of Metals, p. 36, 1985).

(4) No. 56 to No. 58 show the chemical compositions of the steels used for comparison (according to "Low Temperature Mechanical Behavior of Microalloyed and Controlled-Rolled Fe—Mn—Al—C-X Alloys" by Young G. Kim et al., Metal. Trans. A, p. 1689, Sep. 1985).

(5) No. 59 to No. 60 show the chemical compositions of the steels used for comparison. (Two commercialized Fe—Ni—Cr—Mo alloy steel plates. According to the "The Making, Shaping and Treating of Steel" published by United States Steel, 9th edition, p. 1141-1142.)

TABLE II

| The Mechanical Properties of Sample Steels of the Present Invention and Steels Used for Comparison. | | | | | |
|---|---|---|---|---|---|
| No. | Ultimate Strength U.T.S (Ksi) | Yield Strength Y.S. (Ksi) | Elongation El. (%) | Reduction in Area RA (%) | Remarks |
| | 177 | 165 | 36.0 | 44.2 | The Sample Steels of the Present Invention |
| 2 | 128 | 103 | 50.0 | 55.4 | |
| 3 | 168 | 140 | 46.8 | 52.0 | |
| 4 | 136 | 113 | 43.2 | 50.8 | |
| 5 | 170 | 151 | 37.2 | 45.4 | |
| 6 | 184 | 179 | 36.8 | 45.1 | |
| 7 | 158 | 135 | 47.2 | 53.2 | |
| *8 | 185 | 174 | 36.9 | 43.8 | |
| 9 | 136 | 106 | 51.4 | 55.6 | |
| 10 | 212 | 203 | 23.2 | 30.8 | |
| *11 | 154 | 128 | 48.6 | 52.8 | |
| 12 | 181 | 168 | 39.0 | 46.3 | |
| *13 | 170 | 148 | 46.1 | 52.6 | |
| 14 | 162 | 151 | 45.3 | 55.1 | |
| *15 | 159 | 136 | 38.8 | 44.9 | |
| 16 | 148 | 129 | 38.2 | 47.3 | |
| 17 | 202 | 181 | 33.8 | 41.3 | |
| 18 | 156 | 143 | 41.2 | 44.3 | |
| 19 | 188 | 172 | 22.1 | 29.3 | |
| 20 | 212 | 188 | 32.4 | 38.6 | |
| 21 | 141 | 120 | 46.0 | 51.4 | |
| *22 | 156 | 123 | 45.6 | 52.0 | |
| 23 | 146 | 124 | 43.2 | 47.3 | |
| *24 | 163 | 136 | 46.8 | 51.9 | |
| 25 | 138 | 116 | 47.3 | 53.7 | |
| 26 | 169 | 138 | 48.1 | 53.6 | |
| *27 | 205 | 196 | 29.0 | 35.3 | |
| 28 | 168 | 145 | 48.3 | 53.5 | |
| 29 | 158 | 130 | 34.1 | 43.9 | |
| *30 | 155 | 136 | 41.7 | 53.6 | |
| 31 | 168 | 147 | 44.4 | 51.3 | |
| 32 | 151 | 130 | 41.9 | 50.2 | |
| 33 | 126 | 110 | 52.4 | 60.7 | |
| 34 | 172 | 153 | 45.4 | 52.3 | |
| 35 | 182 | 168 | 31.7 | 42.6 | |
| *36 | 202 | 193 | 26.7 | 30.7 | |
| 37 | 158 | 141 | 45.2 | 54.3 | |
| *38 | 163 | 144 | 42.1 | 49.7 | |
| 39 | 164 | 142 | 39.7 | 48.2 | |
| 40 | 183 | 165 | 37.3 | 48.0 | |
| 41 | 185 | 174 | 32.3 | 39.6 | |
| 42 | 158 | 146 | 40.8 | 51.2 | |
| 43 | 148 | 126 | 47.7 | 56.2 | |
| 44 | 123 | 89 | 27.8 | 31.3 | The Sample Steels Used for Comparison |
| 45 | 174 | 153 | 8.3 | 16.1 | |
| 46 | 177 | 155 | 6.1 | 12.6 | |
| 47 | 206 | 198 | 2.3 | 4.5 | |
| 48 | 101 | 78 | 56.0 | 61.3 | |
| 49 | 188 | 181 | 6.5 | 14.3 | |
| 50 | 166 | 157 | 10.6 | 21.2 | |
| 51 | 163 | 148 | 14.2 | 23.2 | |
| 52 | 161 | 151 | 18.6 | 27.3 | |

TABLE II-continued

| The Mechanical Properties of Sample Steels of the Present Invention and Steels Used for Comparison. | | | | | |
|---|---|---|---|---|---|
| No. | Ultimate Strength U.T.S (Ksi) | Yield Strength Y.S. (Ksi) | Elongation El. (%) | Reduction in Area RA (%) | Remarks |
| 53 | 161 | 145 | 15.8 | 26.1 | |
| 54 | 125 | 72 | 62.0 | 57.0 | |
| 55 | 133 | 104 | 56.3 | 61.0 | |
| 56 | 105 | 83 | 33.8 | — | |
| 57 | 109 | 84 | 29.1 | 51.0 | |
| 58 | 107 | 91 | 32.4 | — | |
| 59 | 150 | 130 | 15.0 | 50.0 | |
| 60 | 135 | 100 | 16.0 | 50.0 | |

Brief Description of Table II (1) No. 1 to No. 43 show the mechanical properties of the sample steels of the present invention. ("*" denotes the finish rolling temperature is 830° C., and it is 920° C. for the others.)

(2) No. 44 to No. 53 show the mechanical properties of the sample steels used for comparison.

(3) No. 54 to No. 55 show the mechanical properties of the steels used for comparison (according to "An Assessment of Fe—Mn—Al Alloys as Substitutes for Stainless Steel" by H. W. Leavenworth, Jr. and J. C. Benz, Journal of Metals, p. 36, 1985).

(4) No. 56 to No. 58 show the mechanical properties of the steels used for comparison (according to "Low Temperature Mechanical Behavior of Microalloyed and Controlled-Rolled Fe—Mn—Al—C-X Alloys" by Young G. Kim et al., Metal. Trans. A, p. 1689, Sep. 1985).

(5) No. 59 to No. 60 show the mechanical properties of the steels used for comparison. (Two commercialized Fe—Ni—Cr—Mo hot-rolled alloy steels. According to the "The Making, Shaping and Treating of Steel" published by United States Steel, 9th edition, p. 1141-1142. The mechanical properties are obtained when the steels are austenitized, quenched and then tempered at about 565° C.

EXAMPLE I

The present example is to demonstrate that at the finish rolling temperature, extremely fine $(Fe,Mn,M)_3AlC_x$ carbides have already homogeneously distributed within austenite matrix of the steel plate obtained from the present invention. During the air-cooling from the finish rolling temperature to room temperature, these pre-existing extremely fine carbides act as nuclei for precipitates to grow, which results in the formation of a large amount of fine carbides within austenite matrix. Having this feature, the steel plate of the present invention thus possesses an excellent tensile strength accompanied with a high ductility in as hot-rolled condition.

Two sample steels containing the chemical compositions of No. 6 and No. 44 listed in Table I were examined in the present example. No. 6 is the sample steel of the present invention and No. 44 is the sample steel used for comparison. The chemical composition of No. 44 sample steel is similar to that of No. 6 sample steel except for containing no titanium and chromium. Two steel ingots containing the chemical compositions of No. 6 and No. 44 were prepared with a high frequency induction furnace respectively. The size of the ingots was 80 mm in width, 40 mm in thickness and 300 mm in length. After being heated at 1200° C. for 2 hours, the steel ingots were continuously hot-rolled to a final thickness of 5.0 mm and then air-cooled from the finish rolling temperature of 920° C. to room temperature. The reduction in thickness was about 87.5%.

Figure 6:
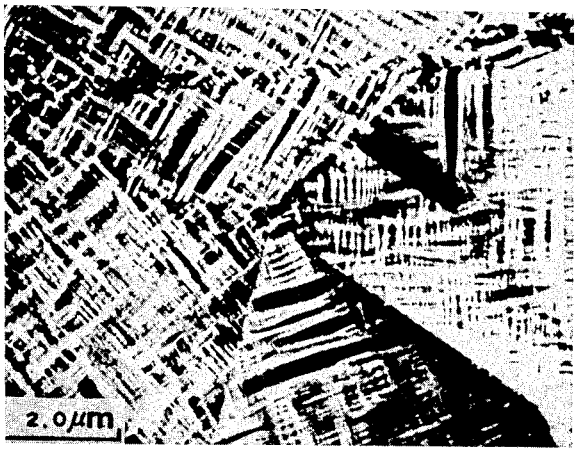
FIG. 6 Bright field TEM micrograph of No. 44 sample steel used for comparison. The sample steel was continuously hot-rolled from 1200° C., and then air-cooled from the finish rolling temperature of 920° C. to room temperature.

FIGS. 5(*a*) through 5(*g*) show the TEM micrographs of No. 6 sample steel after undergoing the above-mentioned process. Fine precipitates with surrounding bright contrast can be clearly seen in FIG. 5(*a*), which is bright-field TEM micrograph. The selected area diffraction patterns taken from the mixed region of austenite matrix and fine precipitates are shown in FIGS. 5(*b*) to 5(*f*). The zone axes are [001], [011], [$\bar{1}$11], [$\bar{1}$12] and [$\bar{1}$23] of austenite matrix respectively. In addition to the spots corresponding to austenite matrix, the diffraction patterns also consist of small superlattice spots caused by the presence of fine precipitates. Based on the analyses of the diffraction patterns, it can be confirmed that the fine precipitates within austenite matrix are $(Fe,Mn,M)_3AlC_x$ carbides having $L'1_2$-type structure. FIG. 5(*g*), a dark-field TEM micrograph taken from the same area in FIG. 5(*a*), clearly shows that the carbides precipitated within austenite matrix are very fine in size which is about 100 Å–300 Å. The tensile-test result shows that the ultimate strength, yield strength and elongation of No. 6 sample steel in as hot-rolled condition are 184 Ksi, 179 Ksi and 36.8% respectively. In contrast to the above observation, a large amount of coarser carbides precipitated within austenite matrix was found in No. 44 sample steel, as shown in FIG. 6. The size of carbides is about 3600 Å–32000Å in length and 520 Å–2200Å in width. The tensile-test result shows that the ultimate strength, yield strength and elongation of No. 44 sample steel in as hot-rolled condition are 123 Ksi, 89Ksi and 27.8% respectively.

Figure 7A:
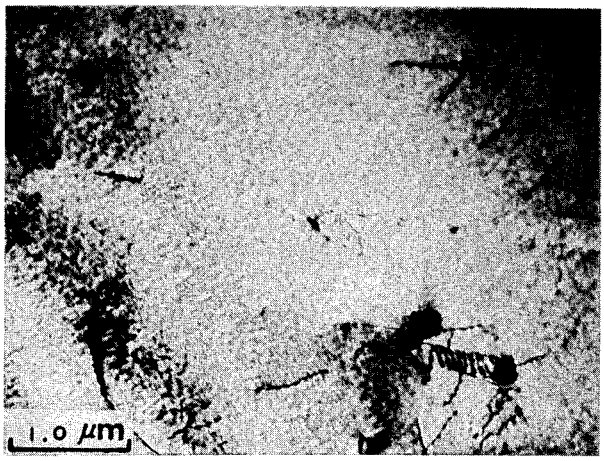
FIG. 7 TEM micrographs of the sample steels after being continuously hot-rolled from 1200° C., and then quenched into water from the finish rolling temperature of 920° C. (a) and (b) The bright field micrograph and selected area diffraction pattern taken from No. 6 sample steel of the present invention respectively (the spot marked by an arrow is the diffraction spot of the precipitates). (c) The selected area diffraction pattern taken from No. 44 sample steel used for comparison.
Figure 7B:
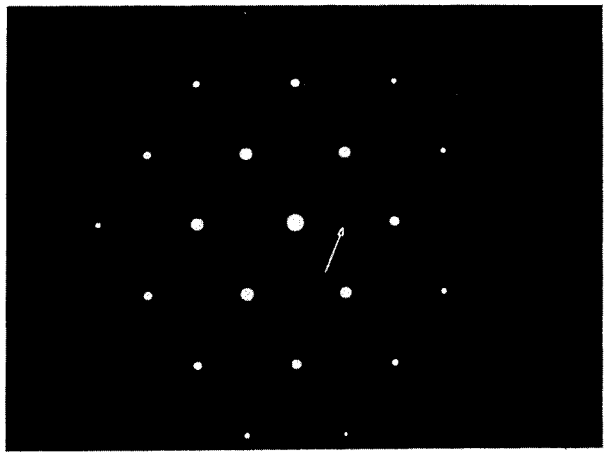
Figure 7C:
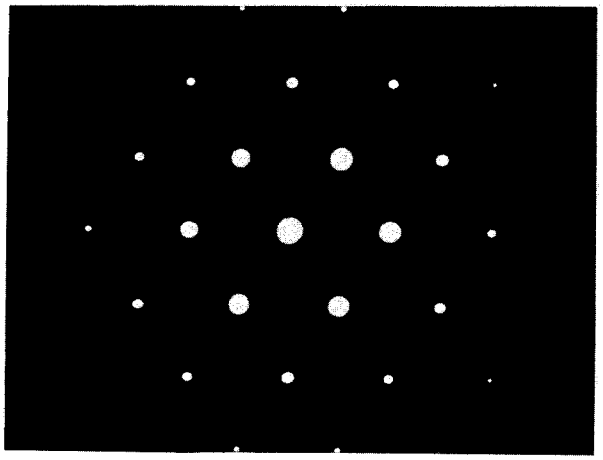

Furthermore, in order to show another feature of the present invention, two steel ingots having the same chemical compositions as those of No. 6 and No. 44 sample steels respectively started to be continuously hot-rolled from 1200° C. and were rapidly quenched into water instead of being air-cooled from the finish rolling temperature of 920° C. to room temperature. FIGS. 7(*a*) and 7(*b*) are the bright-field TEM micrograph and selected area diffraction pattern of No. 6 sample steel in as-quenched condition respectively. FIG. 7(*c*) shows the selected area diffraction pattern of No. 44 sample steel. By comparing FIG. 7(*b*) with FIG. 7(*c*), it is noticed that extremely fine carbides have already precipitated within austenite matrix of No. 6 sample steel at the finish rolling temperature. On the other hand, the diffraction pattern taken from No. 44 sample steel reveals only diffraction spots of austenite matrix and no diffraction spots of precipitates are observed. It implies that no precipitates have been formed in No. 44 sample steel at the finish rolling temperature.

Based on the above observations and analyses, it is believed that at the finish rolling temperature extremely fine carbides have already precipitated coherently within austenite matrix in the No. 6 sample steel of the present invention. During the air-cooling process, these pre-existing extremely fine carbides act as nuclei for precipitates to grow. The resulting carbides not only are very fine but also have a droplet-like morphology, while the carbides formed in the No. 44 sample steel not only are much coarser but also have a plate-like morphology with certain preferred orientations. It clarifies why the steel plate of the present invention possesses a far better tensile strength accompanied with a higher ductility. This is a very important feature of the present invention.

EXAMPLE 2

Figure 1A:
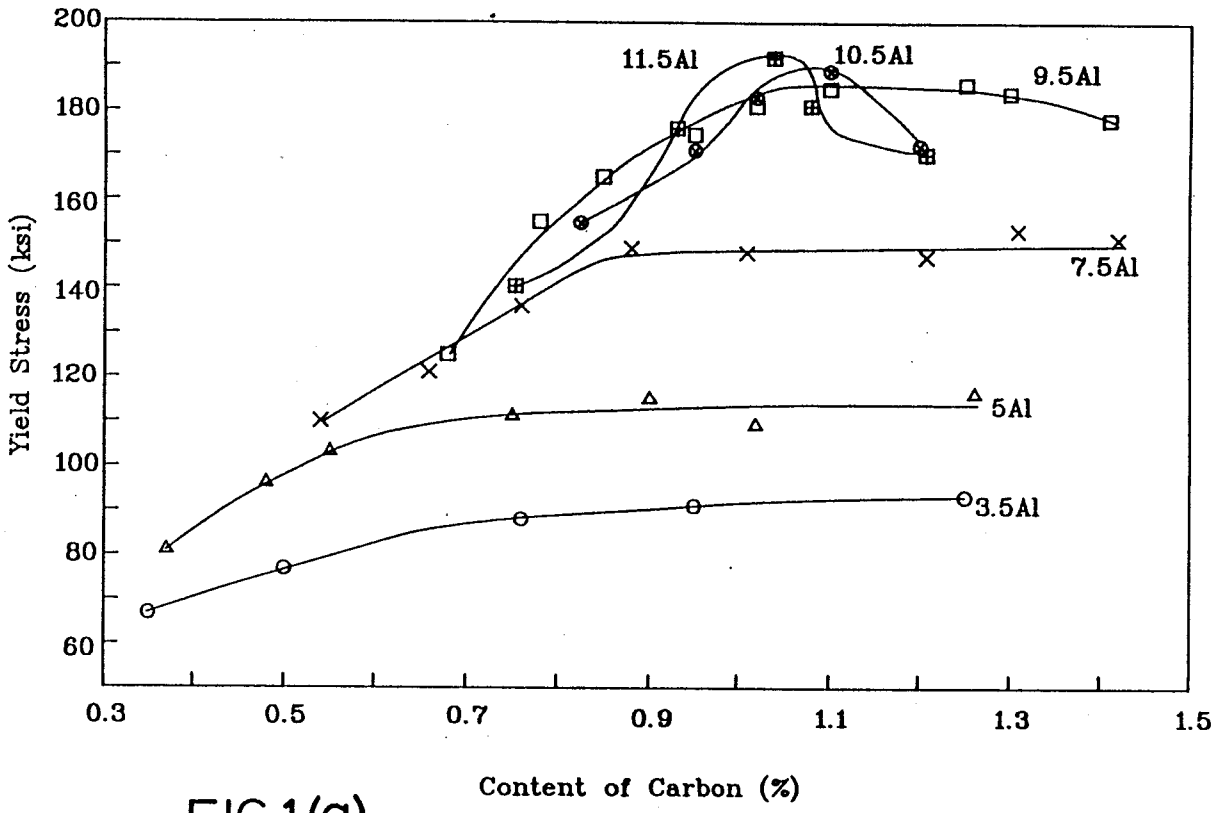
FIG. 1 The effects of aluminum and carbon contents on the (a) yield strength (b) elongation of the Fe-29.8 wt % Mn-0.12 wt % Ti-0.08 wt % Nb-Al-C alloy.
Figure 1B:
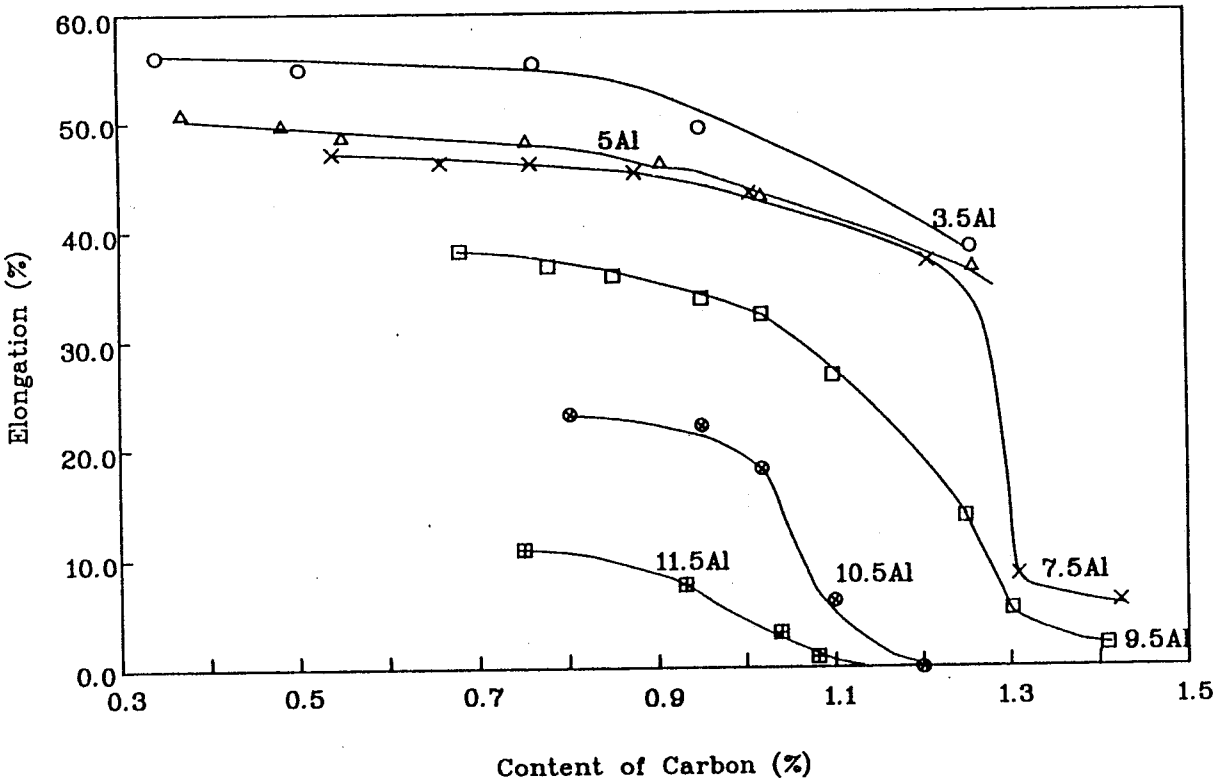
Figure 2:
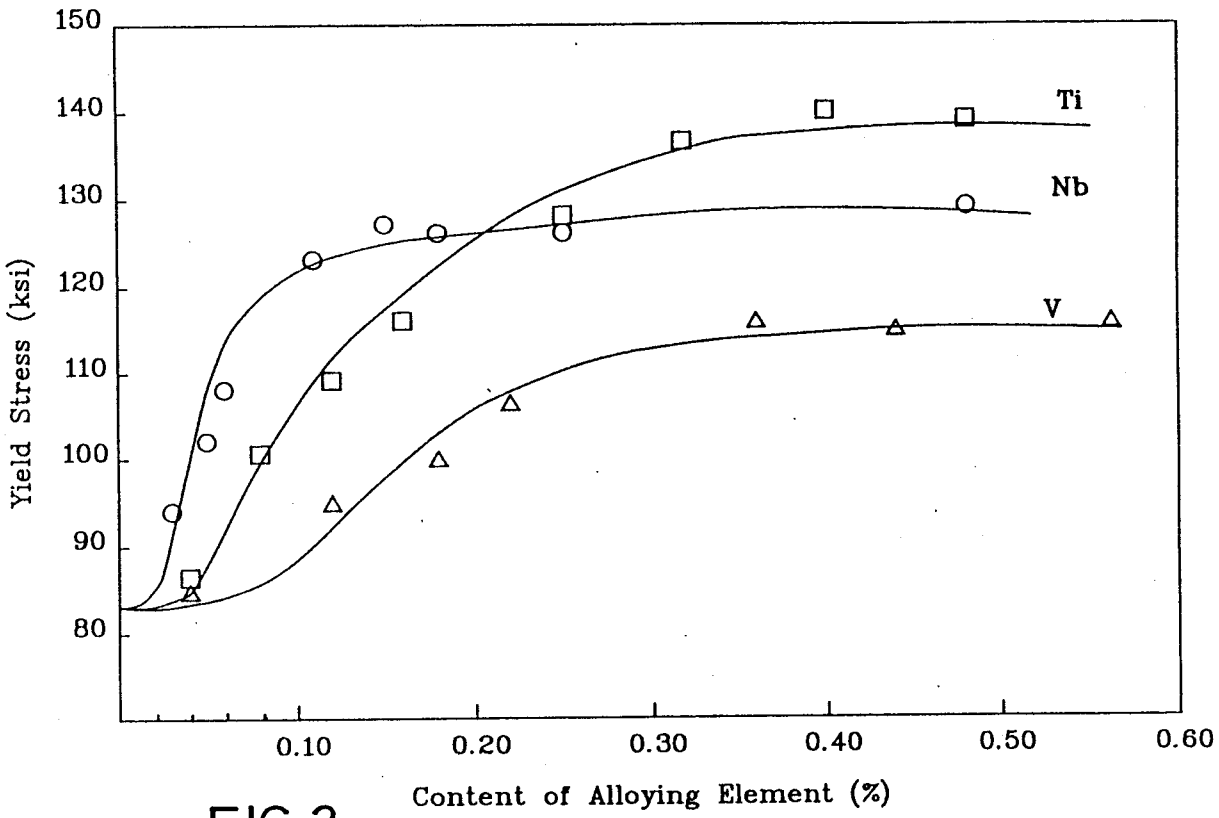
FIG. 2 The effects of titanium, niobium or vanadium content on the yield strength of the Fe-7.0 wt % Al-26.0 wt % Mn-0.60 wt % C-X alloy ("X" stands for titanium, niobium or vanadium).
Figure 8:
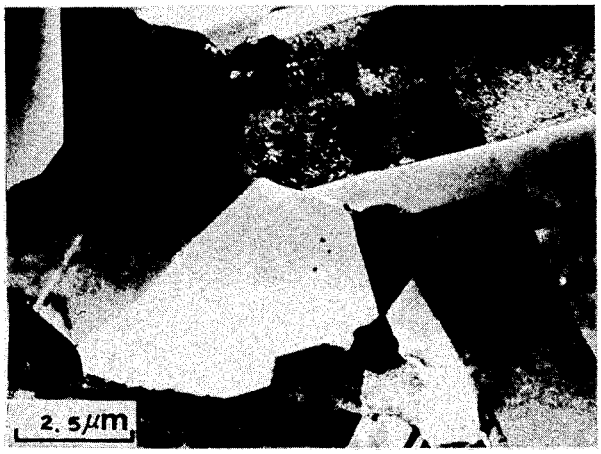
FIG. 8 Bright field TEM micrograph of No. 2 sample steel of the present invention. The sample steel was continuously hot-rolled and then air-cooled from the finish rolling temperature of 920° C. to room temperature.
Figure 9:
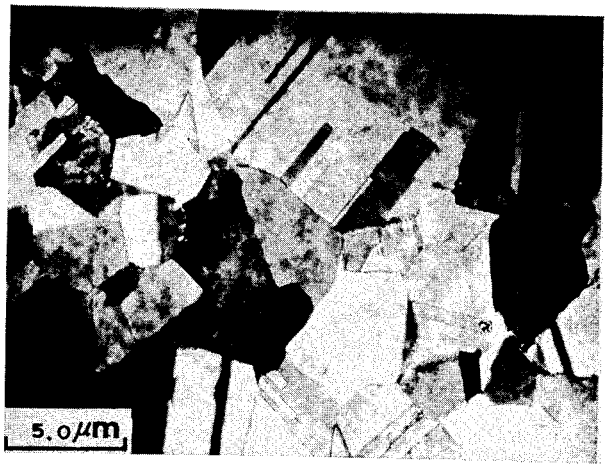
FIG. 9 Bright field TEM micrograph of No. 48 sample steel used for comparison. The sample steel was continuously hot-rolled and then air-cooled from the finish rolling temperature of 920° C. to room temperature.

The present example is to show the effects of aluminum content on the microstructures and mechanical properties. Two sample steels containing the chemical compositions of No. 2 and No. 48 listed in Table I. were examined in the present example. No. 2 is the sample steel of the present invention and No. 48 is the sample steel used for comparison. The chemical composition of No. 48 sample steel is similar to that of No. 2 sample steel except that it contains less aluminum. After being continuously hot-rolled and air-cooled from the finish rolling temperature of 920° C. to room temperature, a large amount of fine carbides has precipitated coherently within austenite matrix in No. 2 sample steel, while there is very little carbide formed within austenite matrix in No. 48 sample steel, as shown in FIG. 8 and FIG. 9 respectively. In Table II, it can be seen that the strength of these two sample steels is far different from each other. Based on the present example and FIG. 1, it can be concluded that in order to obtain a satisfactory strength in as hot-rolled condition, the steel plate should contain more than 4.5 wt % aluminum.

EXAMPLE 3

Figure 10:
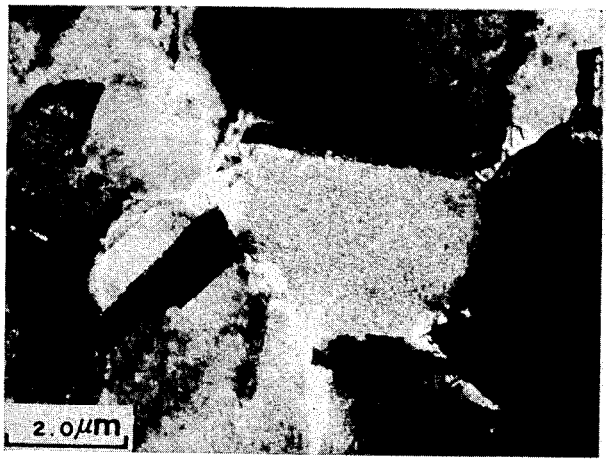
FIG. 10 Bright field TEM micrograph of No. 4 sample steel of the present invention. The sample steel was continuously hot-rolled and then air-cooled from the finish rolling temperature of 920° C. to room temperature.
Figure 11A:
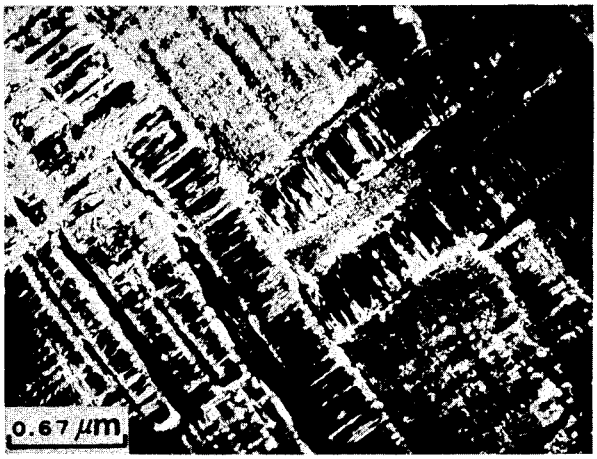
FIG. 11 Bright field TEM micrograph of No. 47 sample steel used for comparison. The sample steel was continuously hot-rolled and then air-cooled from the finish rolling temperature of 920° C. to room temperature. (a) The microstructure within austenite grain. (b) The presence of coarse $(Fe,Mn)_3AlC_x$ carbides on the austenite grain boundaries (The particles marked by an arrow are the grain boundary carbides).
Figure 11B:
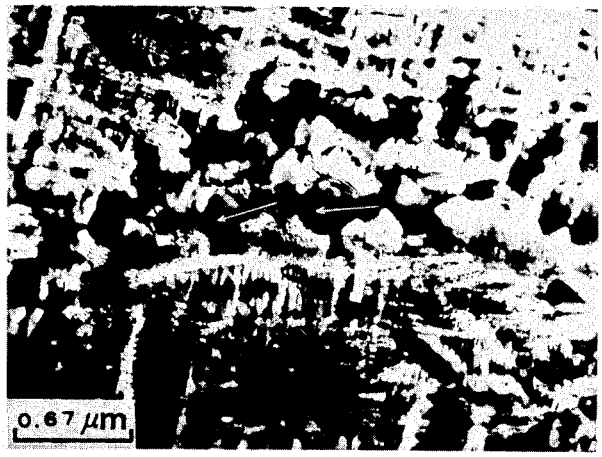

The present example is also to show the effects of aluminum content on the microstructures and mechanical properties. Two sample steels containing the chemical compositions of No. 4 and No. 47 listed in Table I were examined in the present example. No. 4 is the sample steel of the present invention and No. 47 is the sample steel used for comparison. The chemical composition of No. 47 sample steel is similar to that of No. 4 sample steel except for the aluminum content. FIG. 10 and FIG. 11 show the bright-field TEM micrographs of No. 4 and No. 47 sample steels after being continuously hot-rolled and air-cooled from the finish rolling temperature of 920° C. to room temperature respectively. In these two micrographs, it can be seen that when the aluminum content is 5.0 wt % and carbon content is 1.10 wt %, the carbides precipitated within austenite matrix are rather fine and the carbides precipitated on grain boundaries are very small in quantity and fine in size. The tensile-test result shows that the ductility is considerably excellent. On the other hand, when the carbon content is kept at about 1.10 wt % and the aluminum content is increased up to 11.30 wt %, not only the carbides precipitated within austenite matrix are much coarsened but the amount and the size of grain boundary carbides are increased rapidly. Because of the presence of coarser carbides on grain boundaries, the ductility is drastically dropped.

EXAMPLE 4

Figure 12:
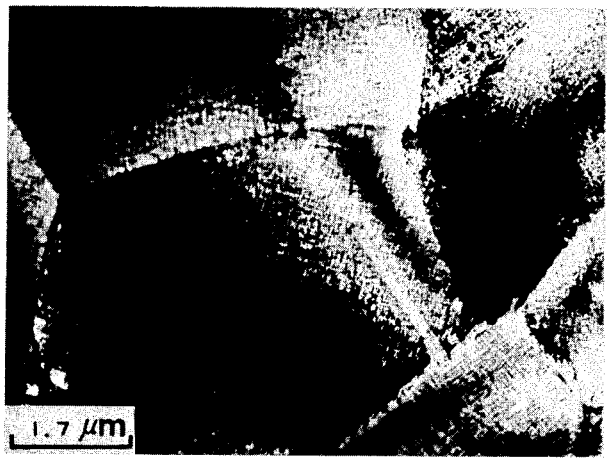
FIG. 12 Bright field TEM micrograph of No. 5 sample steel of the present invention. The sample steel was continuously hot-rolled and then air-cooled from the finish rolling temperature of 920° C. to room temperature.
Figure 13:
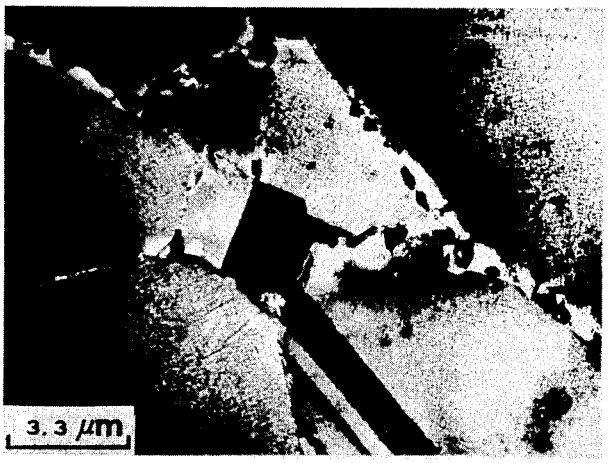
FIG. 13 Bright field TEM micrograph of No. 45 sample steel used for comparison. The sample steel was continuously hot-rolled and then air-cooled from the finish rolling temperature of 920° C. to room temperature.
Figure 14:
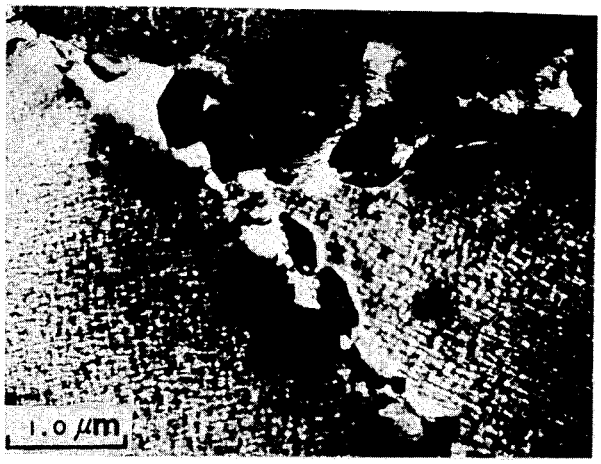
FIG. 14 Bright field TEM micrograph of No. 46 sample steel used for comparison. The sample steel was continuously hot-rolled and then air-cooled from the finish rolling temperature of 920° C. to room temperature.

The present example is to show the effects of carbon content on the microstructures and mechanical properties. Three sample steels containing the chemical compositions of No. 5, No. 45 and No. 46 listed in Table I were examined in the present example. Among them, No. 5 is the sample steel of the present invention, while No. 45 and No. 46 are the sample steels used for comparison. The chemical compositions of No. 45 and No. 46 sample steels are similar to that of No. 5 sample steel except for containing more carbon. FIGS. 12 through 14 show the bright-field TEM micrographs of No. 5, No. 45 and No. 46 sample steels in as hot-rolled conduction respectively. It is apparent in these micrographs that the carbides only precipitated within austenite matrix in the No. 5 sample steel. However, some coarser carbides also precipitated on grain boundaries in addition to within austenite matrix in both No. 45 and No. 46 sample steels. Based on the above observations and FIG. 1(*b*), it can be concluded that in order to prevent the formation of coarser carbides on grain boundaries, the carbon content should be limited below about 1.25 wt %.

EXAMPLE 5

The present example is to show the effects of continuously controlled hot-rolling condition on the precipitation of carbides and mechanical properties. A steel ingot containing the same chemical composition as No. 20 sample steel listed in Table I was prepared for the present examination. The size of the ingot was 80 mm in width, 40 mm in thickness and 300 mm in length. After being heated at 1200° C. for 2 hours, the steel ingot was continuously hot-rolled to a final thickness of 5.0 mm and then air-cooled from the finish rolling temperature to room temperature. The finish rolling temperature was controlled to be 830° C. instead of being 920° C. described in Table II.

Figure 15A:
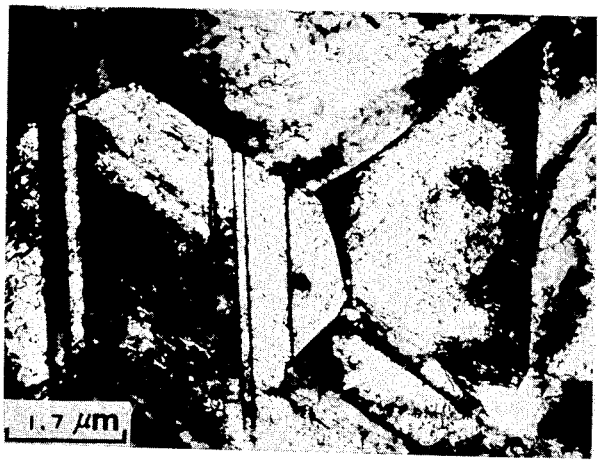
FIG. 15 TEM micrographs of No. 20 sample steel of the present invention. The sample steel was continuously hot-rolled from 1200° C., and then air-cooled from the finish rolling temperature of 830° C. to room temperature. (a) and (b) The bright field TEM micrographs taken from the same area at different magnification. (c) Dark field TEM micrograph taken from the same area in FIG. 15(b).
Figure 15B:
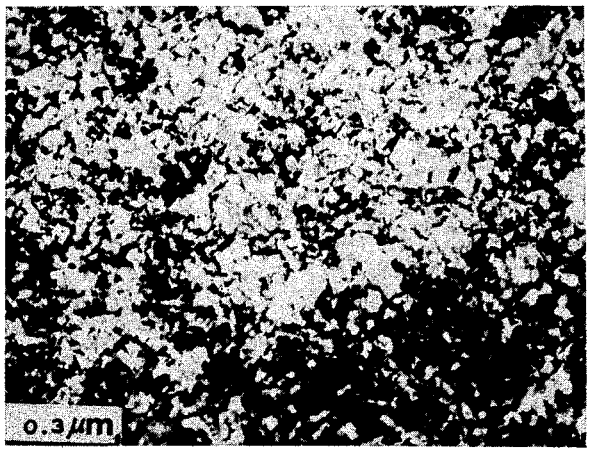
Figure 15C:
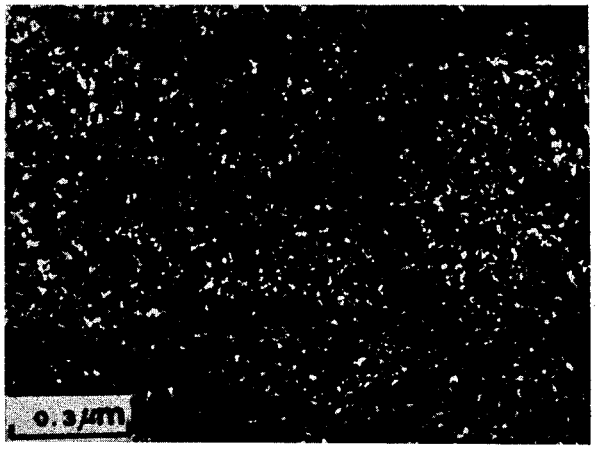
Figure 16A:
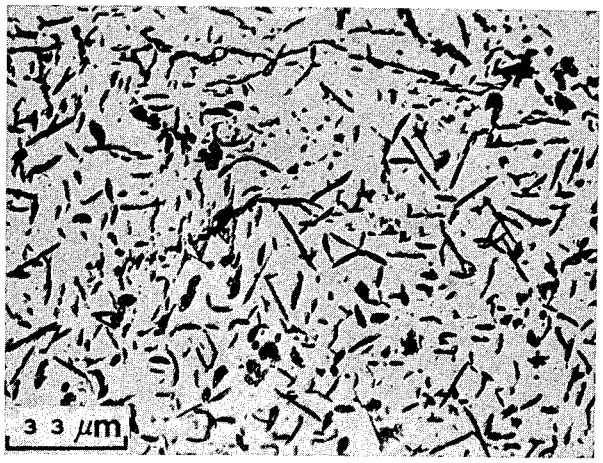
FIG. 16 Micrographs of the Fe-8.0 wt % Al-28.5 wt % Mn-0.90 wt % C-0.30 wt % Ti-4.0 wt % Ni alloy after being continuously hot-rolled from 1200° C., and then air-cooled from the finish rolling temperature of 920° C. to room temperature. (a) An optical micrograph (b) Bright field TEM micrograph, (c)-(d) Selected area diffraction patterns only taken from a rod-like precipitate. The zone axes are [001]and [011]respectively.
Figure 16B:
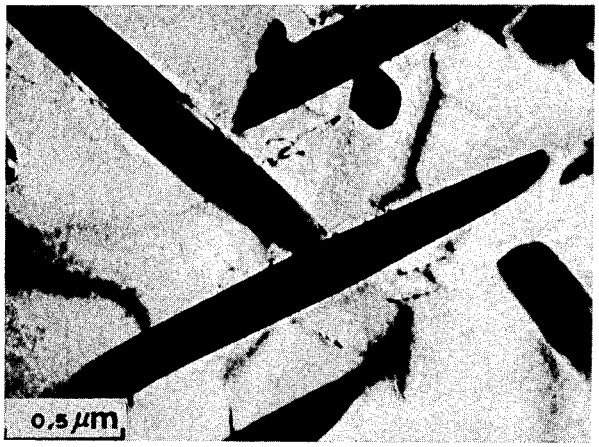
Figure 16C:
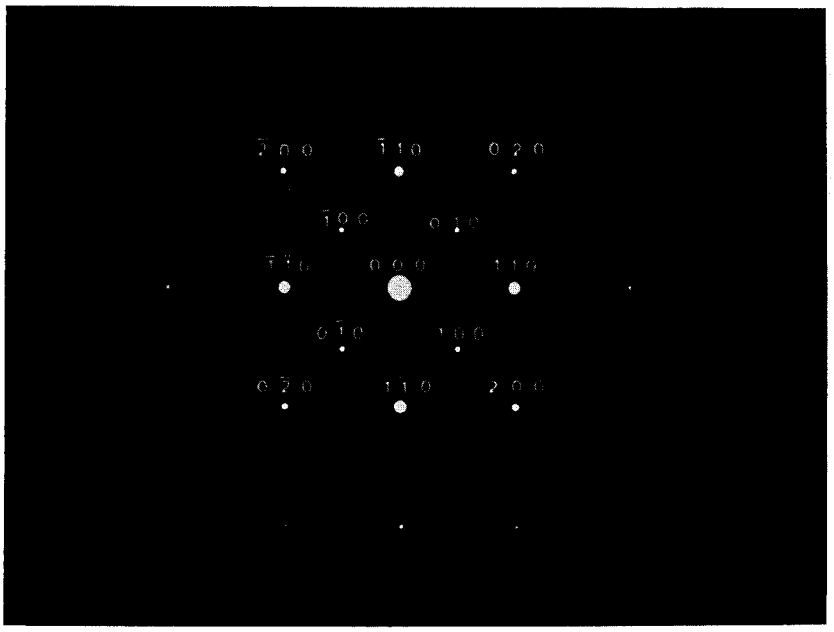
Figure 16D:
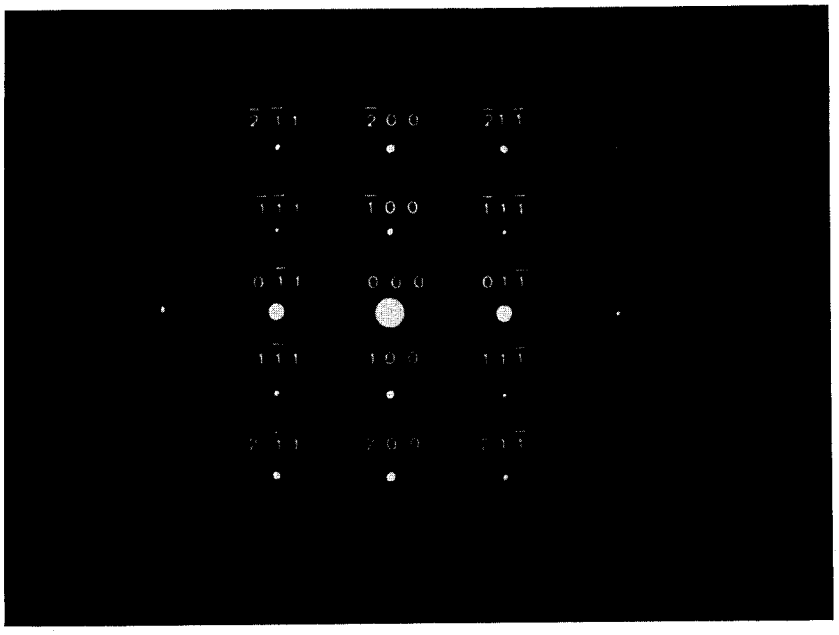
Figure 17A:
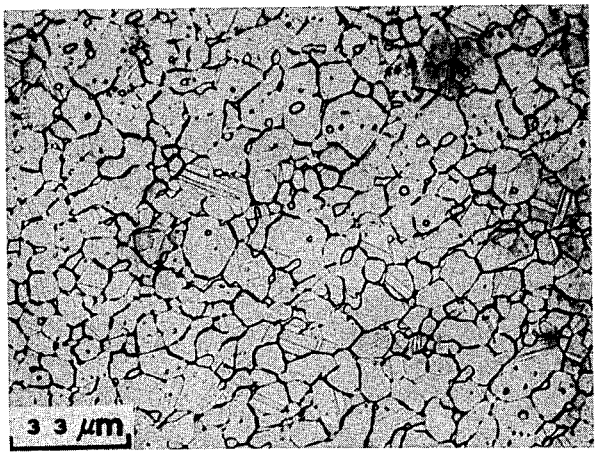
FIG. 17 Optical micrographs of the Fe-6.0 wt % Al25.0 wt % Mn-0.75 wt % C-0.12 wt % Nb-Si alloy in as hot-rolled condition. (a) Si=1.2 wt % (b) Si=1.4 wt % (c) Si=1.8 wt % (d) Si=2.0 wt % respectively.
Figure 17B:
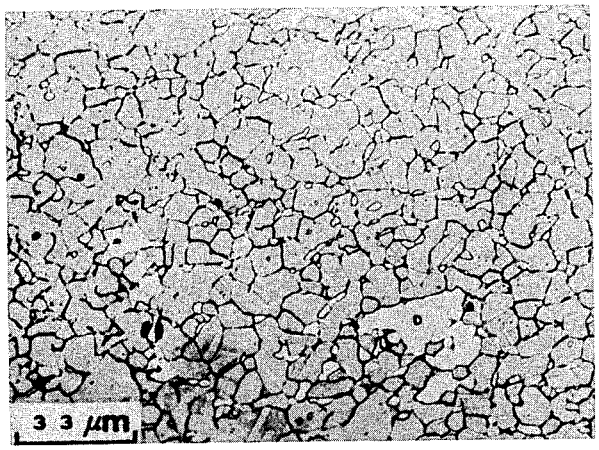
Figure 17C:
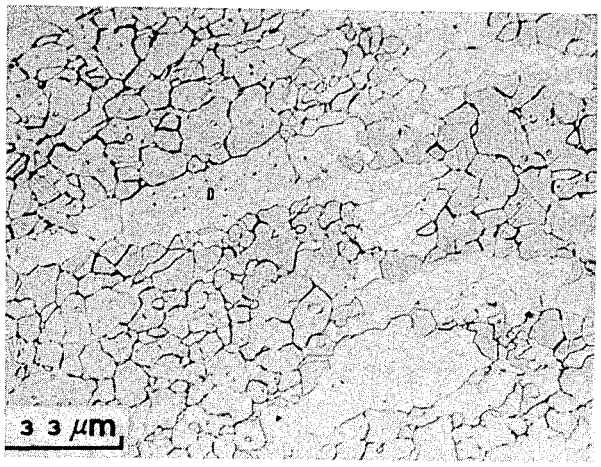
Figure 17D:
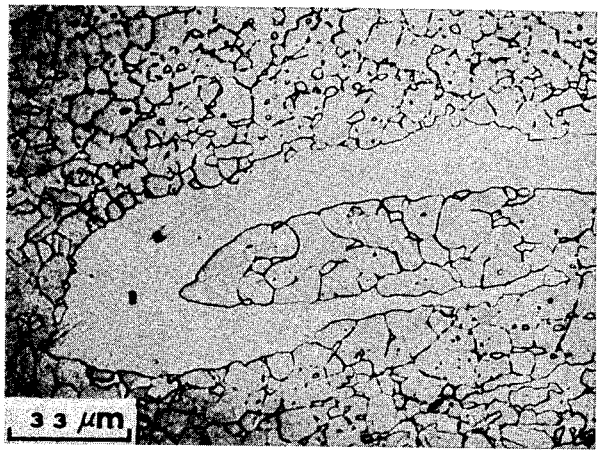
Figure 18A:
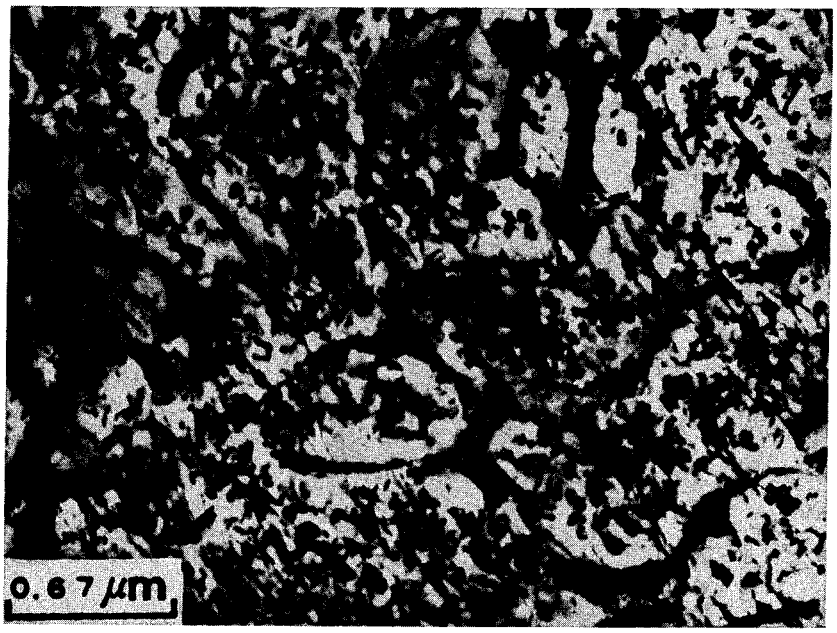
FIG. 18 TEM micrographs of the Fe-6.0 wt % Al-25.0 wt % Mn-0.75 wt % C-0.12 wt % Nb-1.4 wt % Si alloy in as hot-rolled condition. (a) Bright field TEM micrograph (b)-(c) Selected area diffraction patterns taken from an area shown in FIG. 18(*a*). (d)-(e) Dark field TEM micrographs by using (111) and (200) $DO_3$ reflections respectively. (matrix:hkl, $DO_3$:hkl)
Figure 18B:
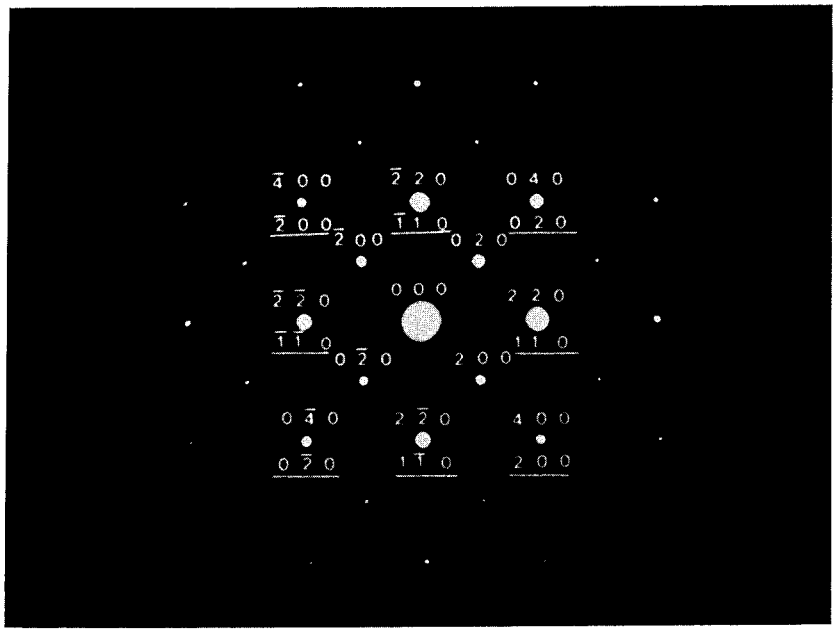
Figure 18C:
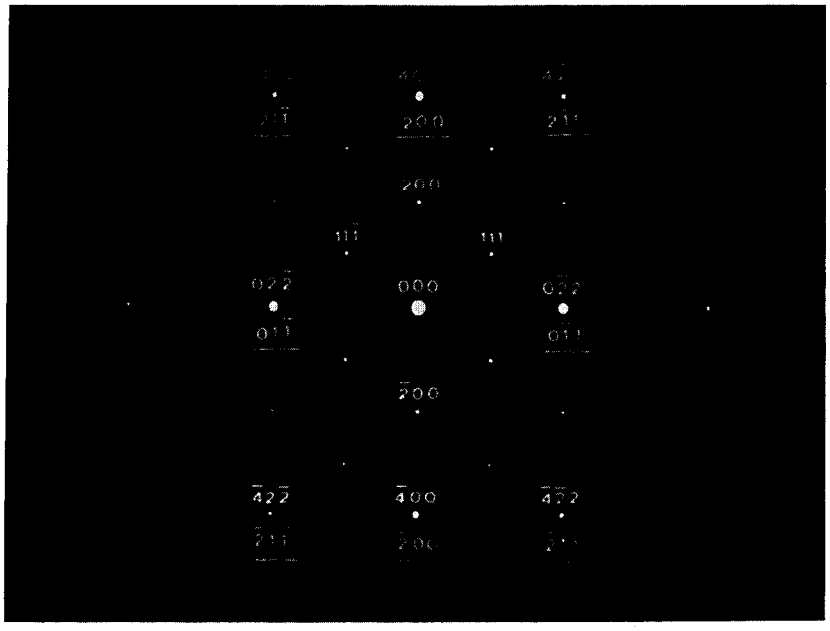
Figure 18D:
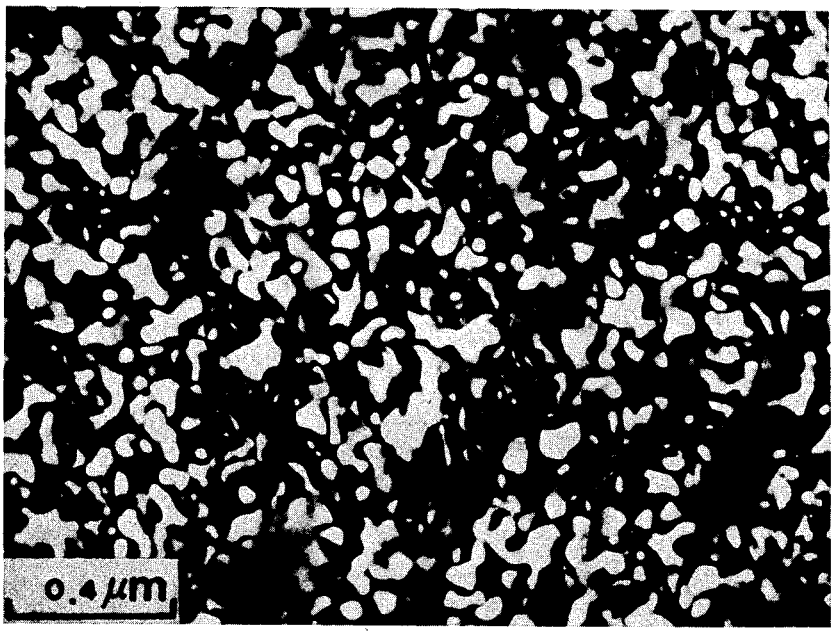
Figure 18E:
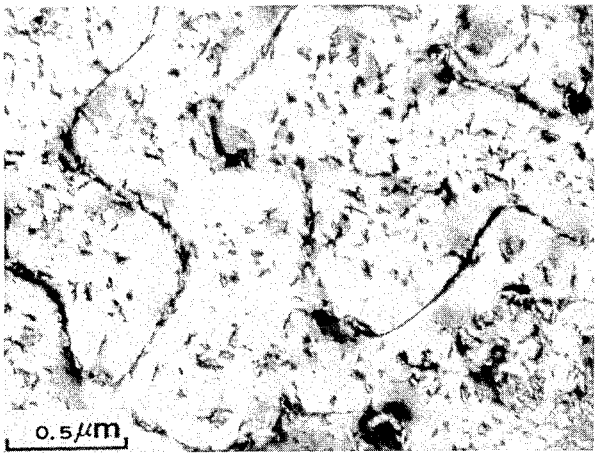

After undergoing the above-mentioned process, a high density of dislocations within austenite matrix was found in the present sample steel, as shown in FIG. 15(*a*). FIG. 15(*b*), a bright-field TEM micrograph taken from the same area in FIG. 15(*a*) but at a higher magnification, clearly reveals that the dislocations were arranged in a typical dislocation cell substurcture. A dark-field TEM micrograph indicates that a large amount of fine carbides precipitated on the dislocation cells, as shown in FIG. 15(*c*). The size of the fine carbides ranges from about 60 Å to 130 Å. In this figure, it can also be seen that a high density of much tinier carbides also precipitated within dislocation cells in addition to on them. The size of these tiny carbides is less than about 50 Å.

It is obvious from the above observations that when the finish rolling temperature is lowered, tiny carbides start to precipitate on the dislocations during hot rolling and then create a pinning action which inhibits the movement of the dislocations. The resulting structure is a high density of dislocation cells remaining within austenite matrix. The tensile-test result shows that the ultimate strength, yield strength and elongation of the present sample steel in as hot-rolled condition are 235 Ksi, 218 Ksi and 29.7 % respectively. It can be seen that the tensile strength of the present sample steel is about 24 Ksi higher than that of the No. 20 sample steel listed in Table II. The remarkable increase in strength is probably attributed to the precipitation of tinier carbides and the formation of dislocation cell substructure. Thus, to control the hot-rolling condition is an another important feature of the present invention.

EXAMPLE 6

The present example is to show the effects of nickel content on the microstructures and mechanical properties. The sample steel containing the chemical composition of Fe-9.0 wt % Al-28.5 wt % Mn-0.90 wt % C-0.30 wt % Ti-4.0 wt % Ni was examined in the present example. The chemical composition of the sample steel is similar to that of No. 12 sample steel of the present invention listed in Table I except for containing much more nickel.

FIG. 16(*a*) shows an optical micrograph of the present sample steel in as hot-rolled condition, revealing the presence of rod-like precipitates within austenite matrix. The bright-field TEM micrograph and selected area diffraction patterns only taken from a rod-like precipitate are shown in FIGS. 16(*b*)–16(*d*) respectively. Based on the analyses of selected area diffraction patterns, it can be confirmed that the rod-like precipitates have an ordered bcc structure which belongs to B2-type (NiAl) ordered phase. The tensile-test result shows that the ultimate strength, yield strength and elongation of the sample steel in as hot-rolled condition are 188 Ksi, 181 Ksi and 6.5% respectively.

Figure 3:
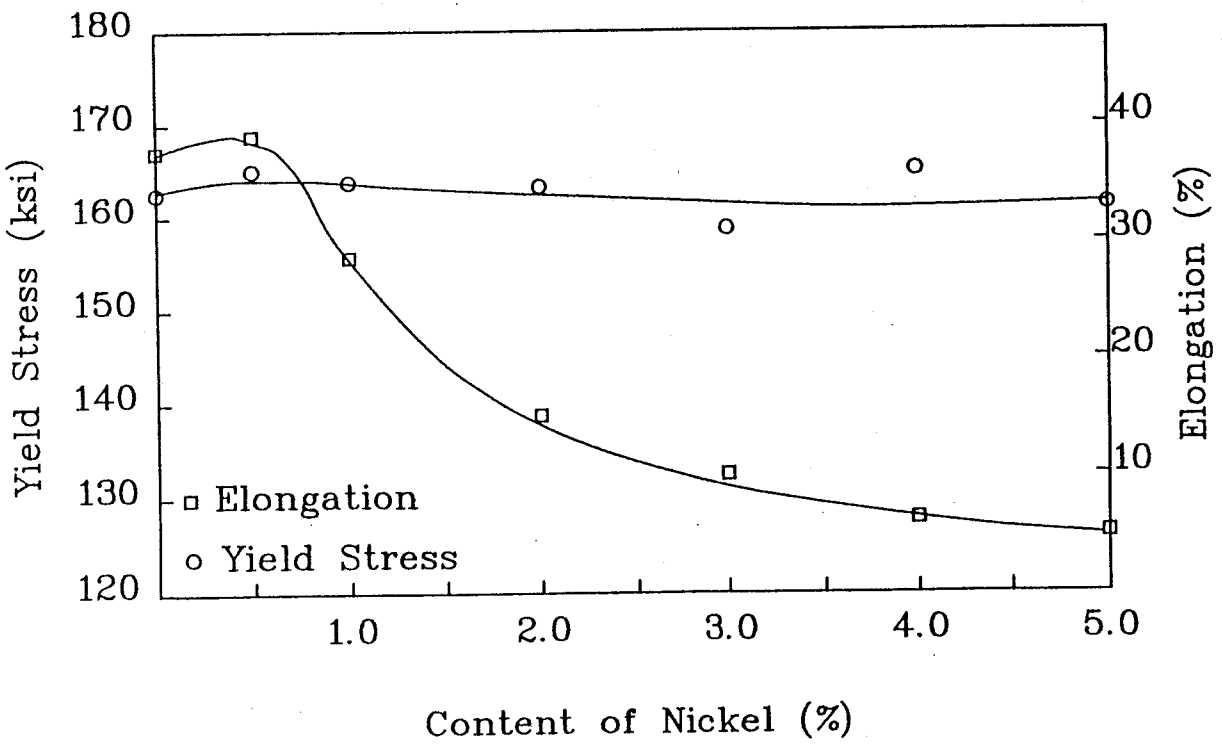
FIG. 3 The effects of nickel content on the yield strength and elongation of the Fe-8.0 wt % Al-28.5 wt % Mn-0.90 wt % C-0.30 wt % Ti-Ni alloy.

Based on the analyses of microstructures and FIG. 3, it can be found that when the nickel content is less than about 0.5 wt %, no B2-type ordered phase was formed within austenite matrix in the hot-rolled steel plate. The ductility of the steel plate slightly increased with increasing nickel content. Increasing the nickel content up to about 1.0 wt % or above, on the other hand, results in the formation of B2 ordered phase within austenite matrix, which not only is helpless to increase the strength but also deteriorates the ductility rapidly.

EXAMPLE 7

The present example is to show the effects of silicon content on the microstructures and mechanical properties. Four sample steels containing the chemical compositions of Fe-6.0 wt % Al-25.0 wt % Mn-0.75 wt % C-0.20 wt % Nb with various amount of silicon were examined in the present example. The silicon contents added to the four sample steels are 1.2, 1.4, 1.8 and 2.0 wt % respectively. After being continuously hot-rolled from 1200° C. and air-cooled from the finish rolling temperature of 920° C. to room temperature, the microstructures of the four sample steels were examined by using optical microscopy and transmission electron microscopy. FIGS. 17(*a*) through 17(*d*) show the optical micrographs of the four sample steels in as hot-rolled condition respectively. In these micrographs, it can be seen that the silicon content above about 1.2 wt % leads to the formation of second phase (i.e. marked D in the figures), and the total volume fraction of the second phase increases with increasing silicon content.

FIGS. 18(*a*)–18(*e*) show the TEM micrographs of the Fe-6.0 wt % Al-25.0 wt % Mn-0.75 wt % C-0.20 wt % Nb-1.40 wt % Si sample steel in as hot-rolled condition. FIG. 18(a), a bright-field TEM micrograph, was taken from an area which corresponds to the second phase marked D in FIGS. 17. FIGS. 18(*b*)–18(*c*) show the selected area diffraction patterns taken from an area shown in FIG. 18(*a*). Based on the analyses of the diffraction patterns, it can be confirmed that the second phase has an ordered face-centered cubic structure which belongs to $DO_3$-type ordered phase. FIGS. 18(*d*) and 18(*e*), dark-field TEM micrographs taken with (111) and (200) $DO_3$ reflections respectively, show the presence of $DO_3$ particles.

Figure 4:
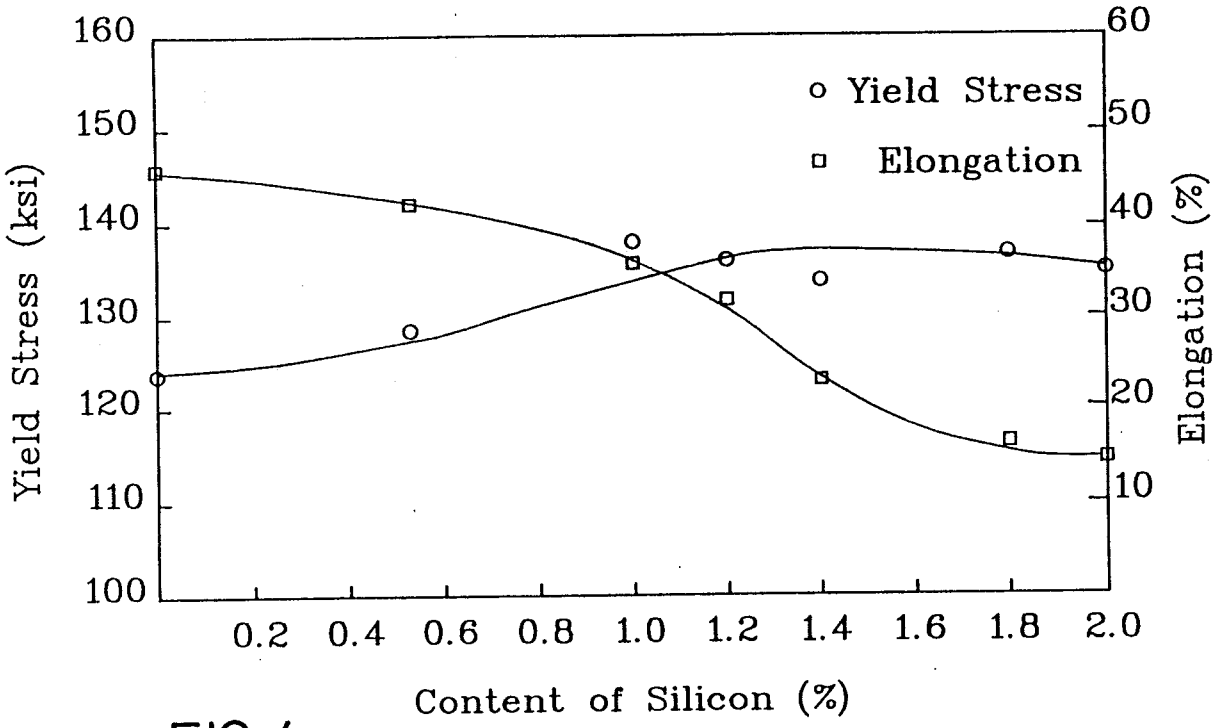
FIG. 4 The effects of silicon content on the yield strength and elongation of the Fe-6.0 wt % Al-25.0 wt % Mn-0.75 wt % C-0.12 wt % Nb-Si alloy.
Figure 5A:
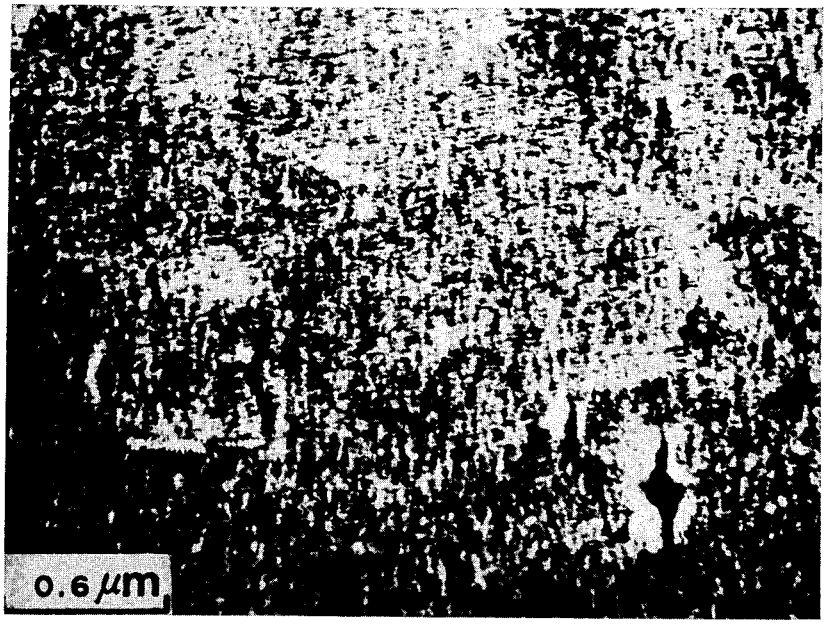
FIG. 5 TEM micrographs of No. 6 sample steel of the present invention. The sample steel was continuously hot-rolled, from 1200° C., and then air-cooled from the finish rolling temperature of 920° C. to room temperature. (a) Bright field micrograph (b)-(f) Selected area diffraction patterns taken from the mixed region of austenite matrix and fine precipitates. The zone axes are [001], [011], [$\bar{1}$11], [$\bar{1}$12]and [$\bar{1}$23]of austenite matrix respectively. (matrix: hkl, $(Fe,Mn,M)_3AlC_x$: hkl). (g) Dark field micrograph.
Figure 5B:
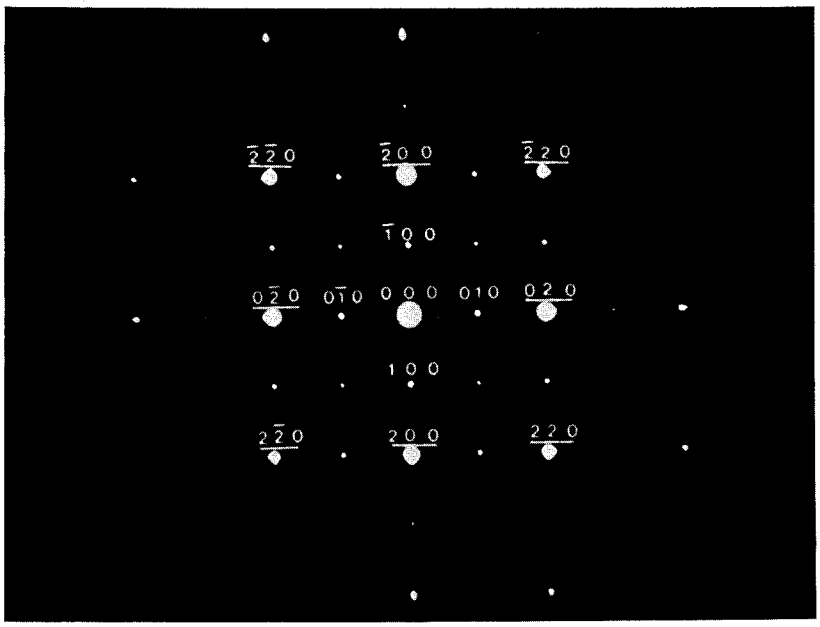
Figure 5C:
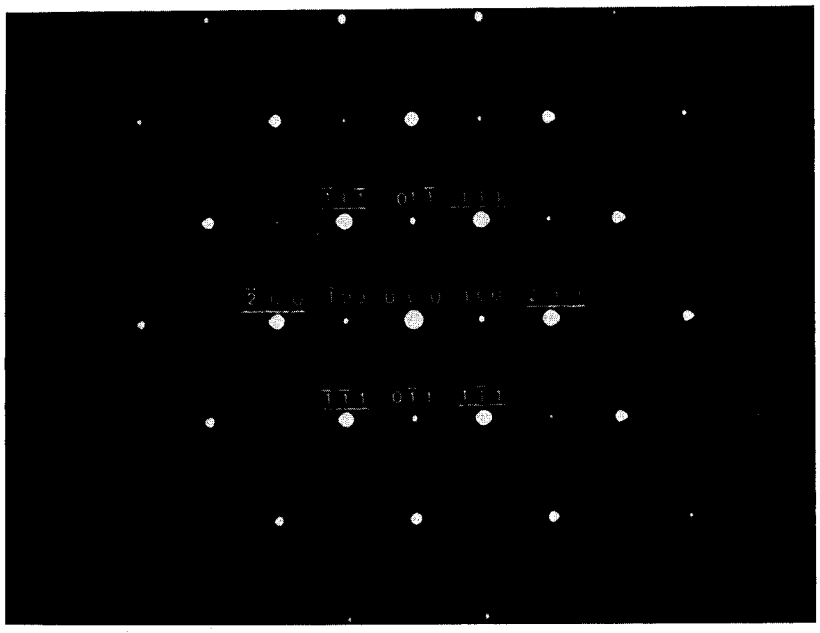
Figure 5D:
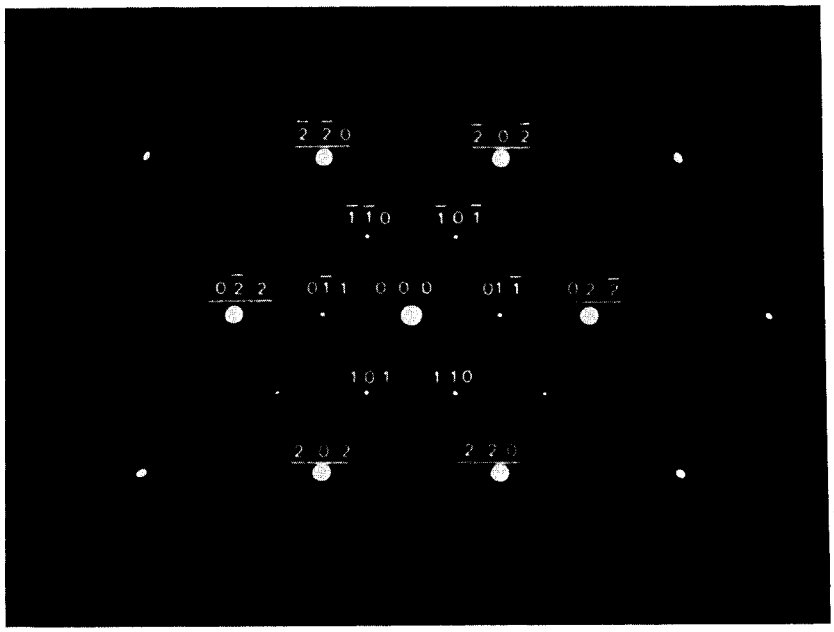
Figure 5E:
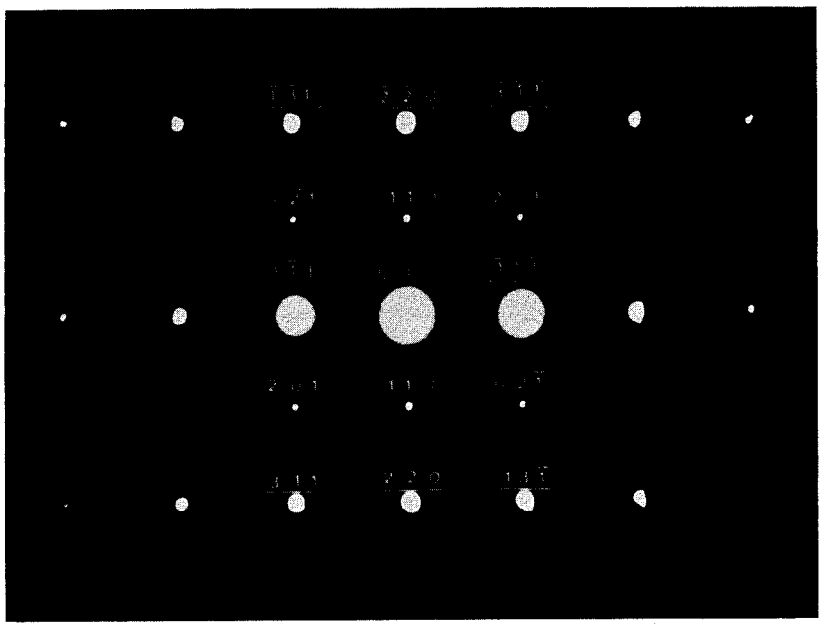
Figure 5F:
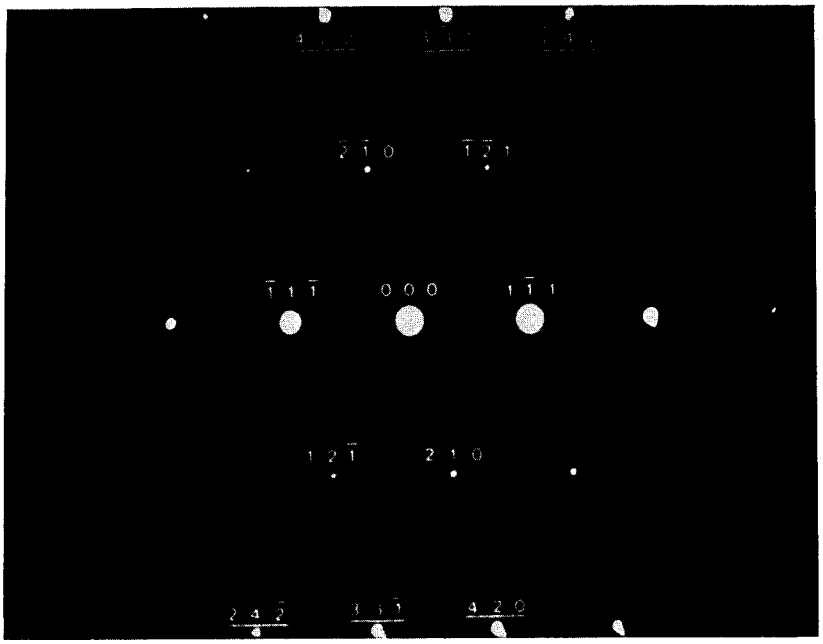
Figure 5G:
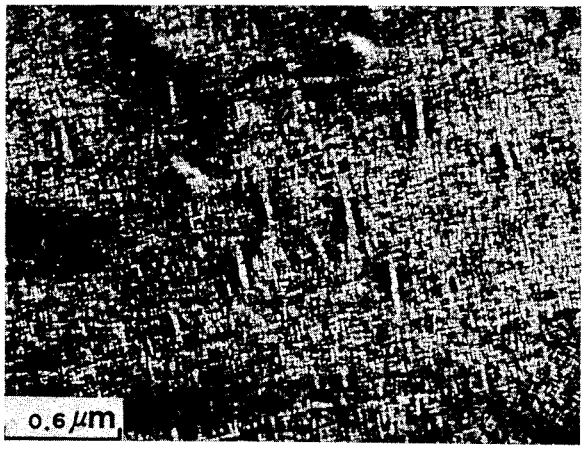

The effects of silicon content on the yield strength and elongation of the Fe-6.0 wt % Al-25.0 wt % Mn-0.75 wt % C-0.12 wt % Nb-Si alloy are shown in FIG. 4. It can be seen that when the silicon content is less than about 1.0 wt %, the yield strength increases with increasing silicon content without any marked loss in ductility. While the silicon content reaches about 1.2 wt % or above, the ductility has a remarkable decrease which is believed to be caused by the formation of $DO_3$-type ordered phase.

EXAMPLE 8

The present example is to show the effects of molybdenum content on the microstructures and mechanical properties. Two sample steels containing the chemical compositions of Fe-6.20 wt % Al-31.3 wt % Mn-0.77 wt % C-0.28 wt % Ti with about 1.0 and 4.5 wt % molybdenum respectively were examined in the present example. The chemical compositions of the two sample steels are similar to that of No. 18 sample steel of the present invention listed in Table I except for containing much more molybdenum. After being continuously hot-rolled from 1200° C. and air-cooled from the finish rolling temperature of 920° C. to room temperature, the microstructures of the two sample steels were examined through TEM, as shown in FIGS. 19 and 20 respectively.

Figure 19A:
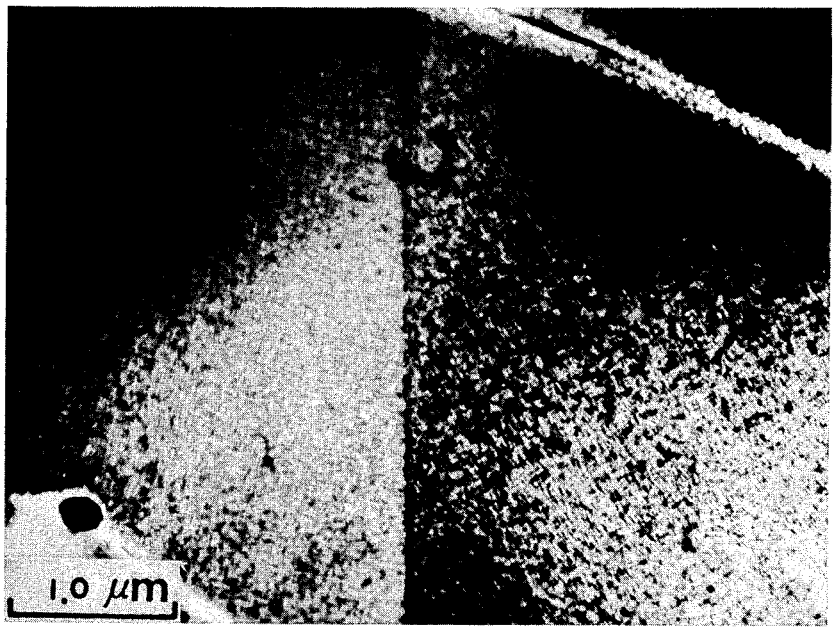
FIG. 19 TEM micrographs of the Fe-6.20 wt % Al-31.3 wt % Mn-0.77 wt % C-0.28 wt % Ti-1.0 wt % Mo alloy in as hot-rolled condition. (a) Bright field TEM micrograph (b) Selected area diffraction pattern taken from a $(Fe,Mo)_6C$ carbide and its surrounding austenite matrix. The zone axes of austenite matrix and $(Fe,Mo)_6C$ carbide are [011] and [011] respectively. (matrix:hkl, $(Fe,Mo)_6C$: hkl)
Figure 19B:
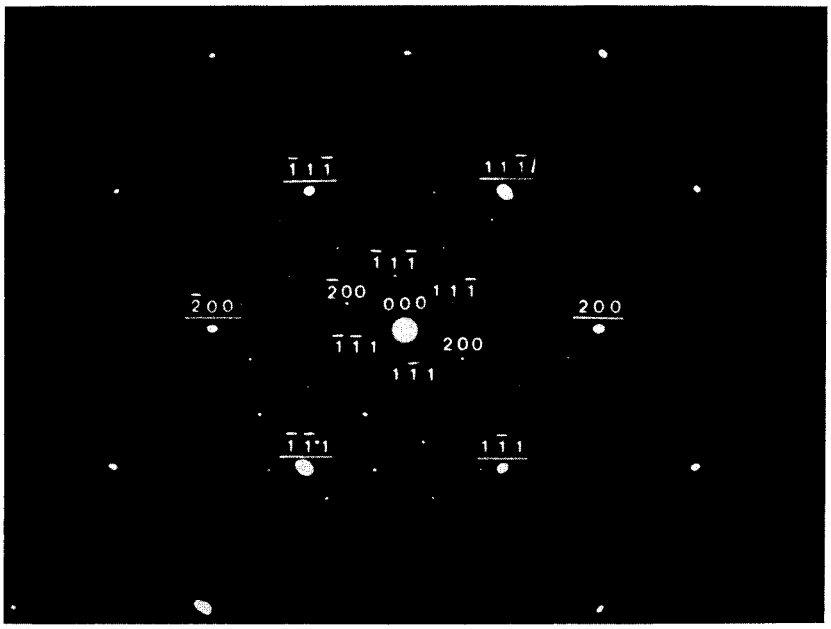
Figure 20:
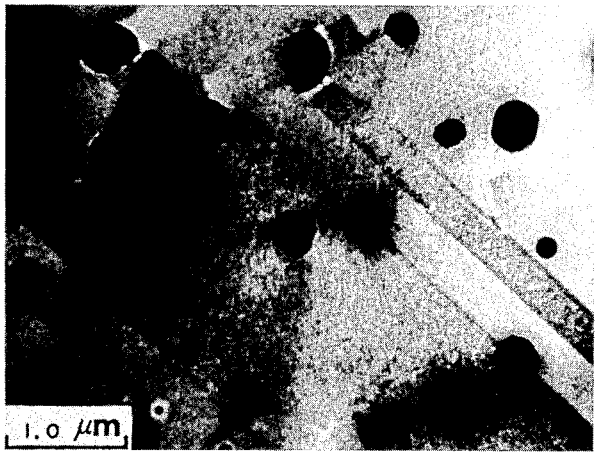
FIG. 20 Bright field TEM micrograph of No. 51 sample steel used for comparison. The sample steel was continuously hot-rolled from 1200° C., and then air-cooled from the finish rolling temperature of 920° C. to room temperature.

In FIG. 19(*a*), it can be seen that some coarse particles are formed within austenite matrix. FIG. 19(*b*) shows the selected area diffraction pattern taken from a coarse particle and its surrounding matrix. Based on the analyses of the diffraction pattern, it can be confirmed that these coarse particles are $(Fe,Mo)_6C$ carbides having a complex f.c.c. structure with lattice parameter a=11.12 Å. The amount of (Fe,Mo)6C carbides increases with increasing molybdenum content, as shown in FIG. 20. The size of these coarse carbides is about 2000 Å to 4500 Å. The mechanical properties of the Fe-6.24 wt % Al-31.1 wt Mn-0.79 wt % C-0.30 wt % Ti-4.48 wt % Mo alloy in as hot-rolled condition are listed in Table II (No. 51). From the comparison of No. 18 and No. 51 sample steels in Table II, it can obviously be seen that the precipitation of these coarse $(Fe,Mo)_6C$ carbides has no apparent improvement on the strength, but deteriorates the ductility of the hot-rolled steel plate rapidly. The experimental results indicate that the molybdenum content should be limited below about 0.5 wt %.

EXAMPLE 9

Figure 21A:
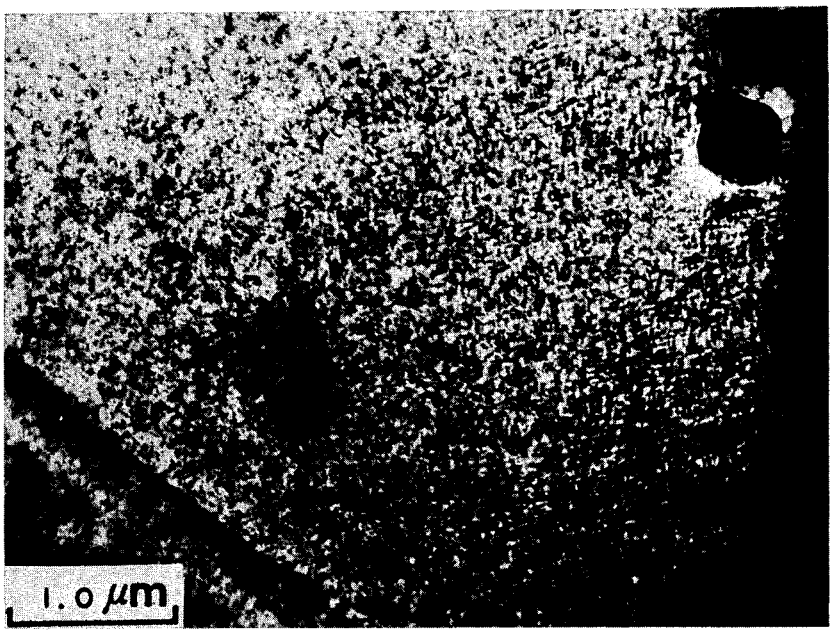
FIG. 21 TEM micrographs of the Fe-6.22 wt % Al-29.6 wt % Mn-0.81 wt % C-0.42 wt % Ti-1.0 wt % W alloy in as hot-rolled condition. (a) Bright field TEM micrograph (b) Selected area diffraction pattern taken from a $(Fe,W)_6C$ carbide and its surrounding austenite matrix. The zone axes of austenite matrix and $(Fe,W)_6C$ carbide are [$\bar{1}$11]and[011]respectively. (matrix : hkl, $(Fe,W)_6C$: hkl).
Figure 21B:
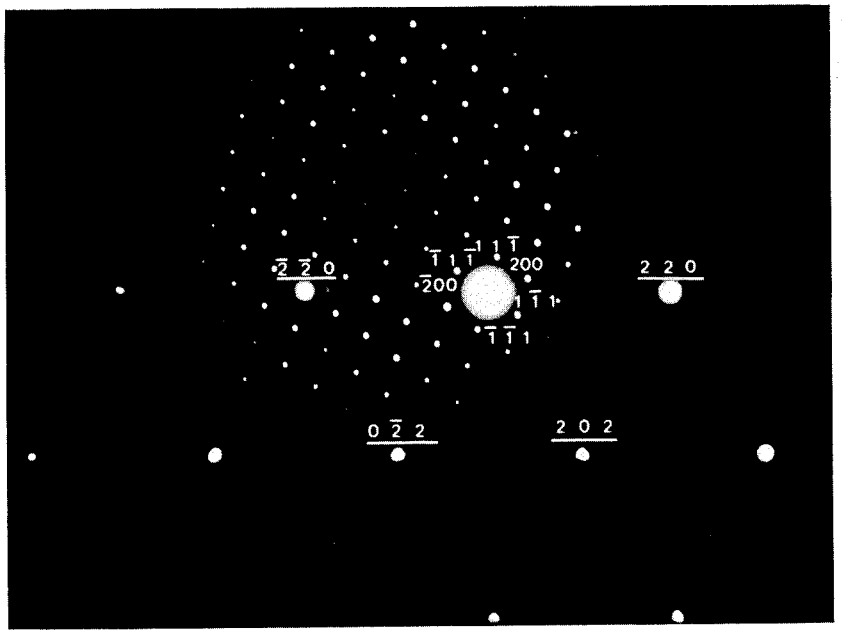
Figure 22:
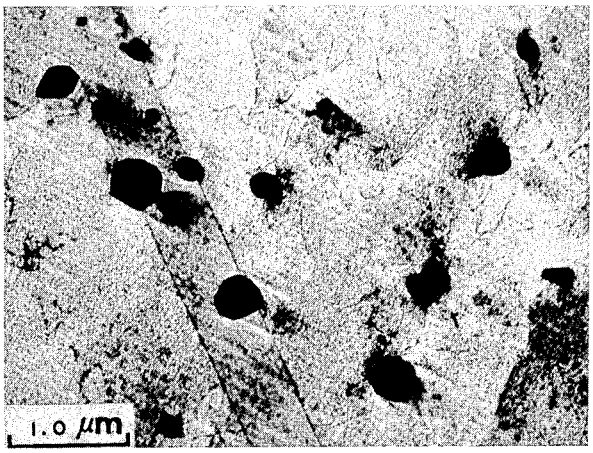
FIG. 22 Bright field TEM micrograph of No. 52 sample steel used for comparison. The sample steel was continuously hot-rolled from 1200° C., and then air-cooled from the finish rolling temperature of 920° C. to room temperature.
Figure 23A:
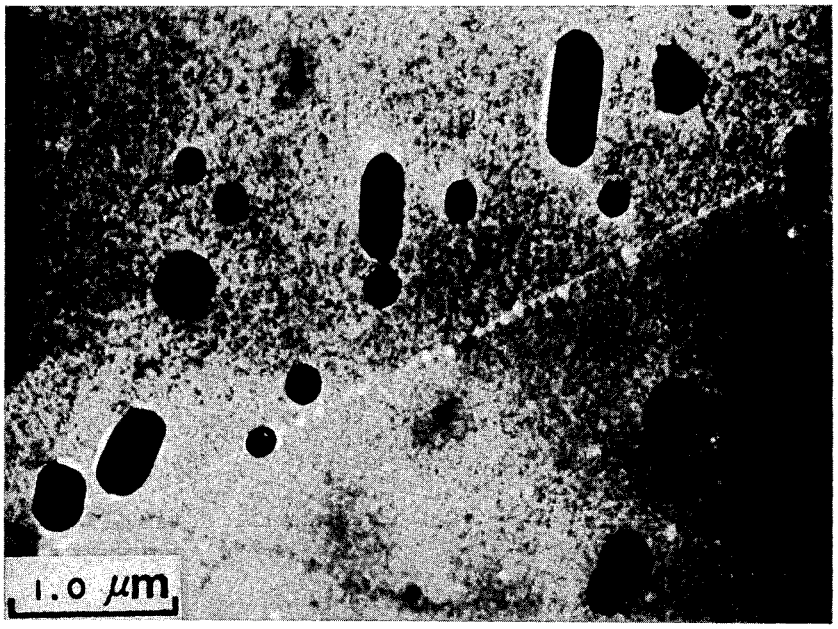
FIG. 23 TEM micrographs of No. 53 sample steel used for comparison. The sample steel was continuously hot-rolled from 1200° C., and then air-cooled from the finish rolling temperature of 920° C. to room temperature. (a) Bright field TEM micrograph (b)-(d) Selected area diffraction patterns taken from a $Cr_7C_3$ carbide. The zone axes are [1$\bar{2}$10], [1$\bar{2}$16] and [1$\bar{2}$13] respectively.
Figure 23B:
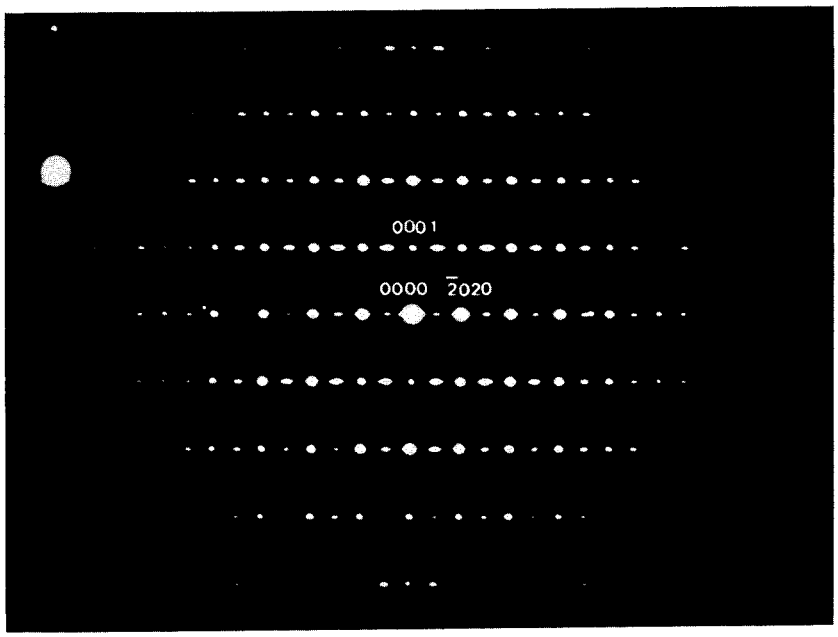
Figure 23C:
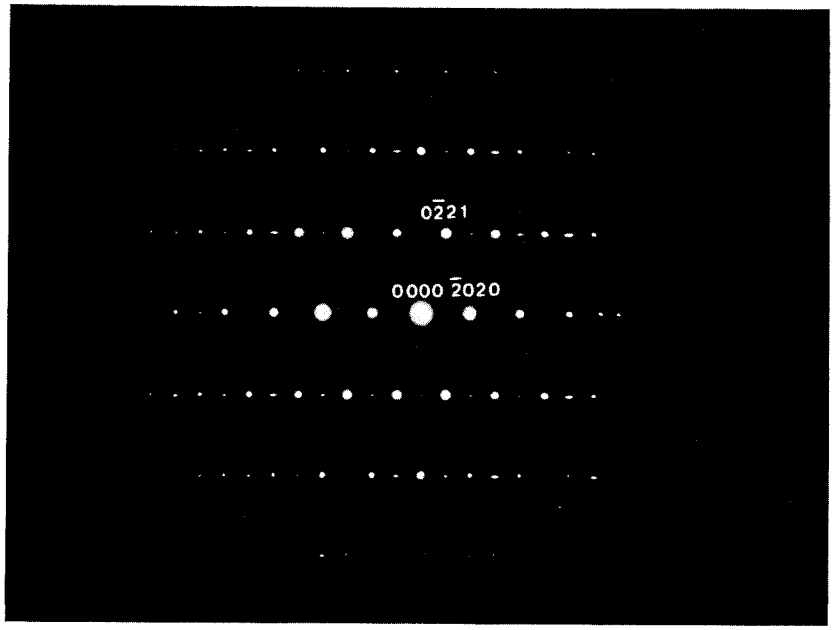
Figure 23D:
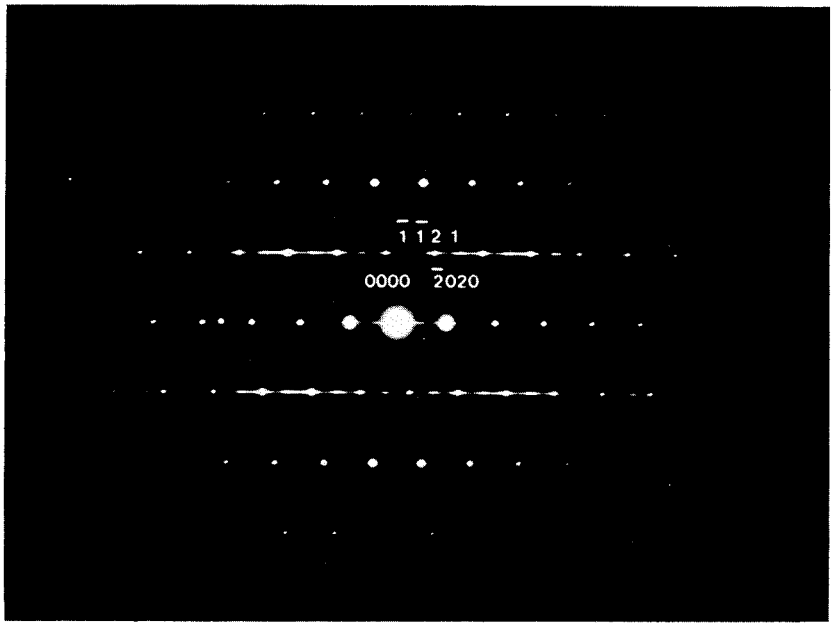

The present example is to show the effects of tungsten content on the microstructures and mechanical properties. Two sample steels containing the chemical compositions of the Fe-6.22 wt % Al-29.6 wt % Mn-0.81 wt % C-0.42 wt % Ti with about 1.0 and 3.0 wt % tungsten respectively were examined in the present example. The chemical compositions of the two sample steels are similar to that of No. 42 sample steel of the present invention listed in Table I except for containing much more tungsten. FIGS. 21 and 22 show the TEM micrographs of the two sample steels in as hot-rolled condition respectively. In FIG. 21(a), it can be seen that some coarse precipitates are formed within austenite matrix. The size of these coarse precipitates is about 1250 Å to 3000 Å. The selected area diffraction pattern taken from the mixed region covering a precipitate and its surrounding austenite matrix is shown in FIG. 21(*b*). Based on the analyses of the diffraction pattern, it can be confirmed that these coarse precipitates are $(Fe,W)_6C$ carbides having a complex f.c.c. structure with lattice parameter a=11.087 Å. With increasing the tungsten content up to about 3.0 wt %, the amount of $(Fe,W)_6C$ increases rapidly, as shown FIG. 22.

According to TEM observations, when the tungsten content is less than about 0.5 wt %, no $(Fe,W)_6C$ carbides are found within austenite matrix in the hot-rolled steel plate. However, increasing the tungsten content up to about 1.0 wt % or above, the $(Fe,W)_6C$ carbides start to form within austenite matrix. From the comparison of No. 42 and No. 52 sample steels in Table II, it can be seen that the formation of these coarse $(Fe,Mo)_6C$ carbides has no apparent improvement on the strength, but deteriorates the ductility of the hot-rolled steel plate rapidly.

EXAMPLE 10

The present example is to show the effects of chromium content on the microstructures and mechanical properties. The sample steel containing the chemical composition of No. 53 sample steel listed in Table I was examined in the present example. The chemical composition of No. 53 sample steel is similar to that of No. 37 sample steel of the present invention except that it contains much more chromium. FIG. 23(*a*) shows the bright field TEM micrograph of No. 53 sample steel in as hot-rolled condition. The selected area diffraction patterns only taken from a coarse particle are shown in FIGS. 23(*b*)–(*d*). Based on the analyses of the selected area diffraction patterns, it can be confirmed that these precipitates are $Cr_7C_3$ carbides having a complex h.c.p. structure with lattice parameters a=13.98 Å and c=4.52 Å. In Table II, it can be seen that the ductility of No. 53 sample steel is far lower than that of No. 37 sample steel of the present invention, which is caused by the formation of coarse $Cr_7C_3$ carbides

We claim:

1. A high strength, high ductility, hot-rolled alloy steel plate having (Fe, Mn, M)$_3$ $AlC_x$ carbides precipitated within an austenite matrix, wherein M is selected from the group consisting of titanium, vanadium and niobium, and where said alloy steel plate having a composition consisting essentially of by weight 4.5 to 9.5 percent aluminum, 22.0 to 36.0 percent manganese, 0.40 to 1.25 percent carbon and at least one of the following constituents, 0.06 to 0.50 percent titanium, 0.02 to 0.20 percent niobium, 0.10 to 0.40 percent vanadium, the balance essentially iron.

2. A high strength, high ductility, hot-rolled alloy steel plate having Fe, Mn, M)$_3AlC_x$ carbides precipitated within an austenite matrix, wherein M is selected from the group consisting of titanium, vanadium and niobium, and where said alloy steel plate having a composition consisting essentially of by weight 4.5 to 9.5 percent aluminum, 22.0 to 36.0 percent manganese, 0.40 to 1.25 percent carbon, 0.06 to 0.50 percent titanium and the balance essentially iron.

3. A high strength, high ductility, hot-rolled alloy steel plate having (Fe, Mn, M)$_3AlC_x$ carbides precipitated within an austenite matrix, wherein M is selected from the group consisting of titanium, vanadium and niobium, and wheresaid alloy steel plate having a composition consisting essentially of by weight 4.5 to 9.5 percent aluminum, 22.0 to 36.0 percent manganese, 0.40 to 1.25 percent carbon, 0.02 to 0.20 percent niobium and the balance essentially iron.

4. A high strength, high ductility, hot-rolled alloy steel plate having (Fe, Mn, M)$_3AlC_x$ carbides precipitated within an austenite matrix, wherein M is selected from the group consisting of titanium, vanadium and niobium, and where said alloy steel plate having a composition consisting essentially by weight 4.5 to 9.5 percent aluminum, 22.0 to 36.0 percent manganese, 0.40 to 1.25 percent carbon, 0.10 to 0.40 percent vanadium and the balance essentially iron.

5. A process for the manufacturing of a hot rolled alloy steel plate as claimed in claim 1 consisting of the following steps:

(a) heating a steel ingot at a temperature in the range of 150° C. to 1250° C.; and (b) hot-rolling the heated alloy steel input and then air cooling at a temperature from the finish rolling temperature to room temperature.

6. The process as claimed in claim 5, wherein the finish rolling temperature is controlled at a temperature range of 800° C. to 1000° C.

7. The process as claimed in claim 6, wherein the finish rolling temperature is controlled at a temperature range of 920° C. to 1000° C.

8. The process as claimed in claim 6, wherein the finish rolling temperature is controlled at a temperature range of 800° C. to 920° C.

* * * * *